US008130187B2

(12) United States Patent
Nakao et al.

(10) Patent No.: US 8,130,187 B2
(45) Date of Patent: Mar. 6, 2012

(54) OCB LIQUID CRYSTAL DISPLAY WITH ACTIVE MATRIX AND SUPPLEMENTAL CAPACITORS AND DRIVING METHOD FOR THE SAME

(75) Inventors: Kenji Nakao, Osaka (JP); Tsuyoshi Uemura, Osaka (JP); Seiji Kawaguchi, Osaka (JP); Junichi Kobayashi, Ishikawa (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 503 days.

(21) Appl. No.: 10/332,948

(22) PCT Filed: Jul. 18, 2001

(86) PCT No.: PCT/JP01/06203

§ 371 (c)(1),
(2), (4) Date: Jul. 16, 2003

(87) PCT Pub. No.: WO02/07142

PCT Pub. Date: Jan. 24, 2002

(65) Prior Publication Data

US 2004/0041766 A1 Mar. 4, 2004

(30) Foreign Application Priority Data

Jul. 19, 2000 (JP) ..... 2000-218543

(51) Int. Cl.
*G09G 3/36* (2006.01)

(52) U.S. Cl. ..... 345/89

(58) Field of Classification Search ..... 345/83, 345/87, 89

See application file for complete search history.

(56) References Cited

U.S. PATENT DOCUMENTS 5,247,289 A * 9/1993 Matsueda ..... 345/98

(Continued)

FOREIGN PATENT DOCUMENTS

EP 0 373 565 A 6/1990

(Continued)

OTHER PUBLICATIONS

"Jyouhoukagakuyou Yuuki Zairyou 142th Iinkai A bukai (liquid crystal material) 71th Kenkyukai Bkai (intelligent organic material) 62nd Kenkyukai Shiryou, Nov. 20, 1998, Nihongakujyutsu Shikoukai p. 1-5".

(Continued)

*Primary Examiner* — Tammy Pham

(74) *Attorney, Agent, or Firm* — McDermott Will & Emery LLP

(57) ABSTRACT

A liquid crystal display comprises: a liquid crystal layer capable of bend orientation; a display screen on which an image is displayed by light transmitted through a bend-oriented liquid crystal layer; and liquid crystal voltage application means for applying a liquid crystal voltage to the liquid crystal layer according to luminance information for each field of image information composed of serial fields, the liquid crystal voltage being applied to cause transmittance of the light to change, thereby sequentially displaying the image corresponding to the fields of the image information, and when the luminance information changes between current and subsequent fields, the liquid crystal voltage application means applies the liquid crystal voltage which changes so as to have a value according to the luminance information by the time the liquid crystal voltage is applied for the subsequent field.

30 Claims, 20 Drawing Sheets

U.S. PATENT DOCUMENTS

| | | | | |
|---|---|---|---|---|
| 5,465,102 | A * | 11/1995 | Usui et al. | 345/89 |
| 6,057,817 | A * | 5/2000 | Ono et al. | 345/94 |
| 6,069,620 | A * | 5/2000 | Nakamura et al. | 345/214 |
| 6,344,839 | B1 * | 2/2002 | Denda et al. | 345/60 |
| 6,384,807 | B1 * | 5/2002 | Furuhashi et al. | 345/96 |
| 6,384,818 | B1 * | 5/2002 | Yamazaki et al. | 345/206 |
| 6,433,765 | B1 * | 8/2002 | Fujiwara et al. | 345/87 |
| 6,545,653 | B1 * | 4/2003 | Takahara et al. | 345/87 |
| 6,600,469 | B1 * | 7/2003 | Nukiyama et al. | 345/87 |
| 6,753,835 | B1 * | 6/2004 | Sakai | 345/87 |

FOREIGN PATENT DOCUMENTS

| | | | |
|---|---|---|---|
| EP | 1 070 981 | A1 | 1/2001 |
| EP | 1 118 900 | A1 | 7/2001 |
| JP | 2-157815 | | 6/1990 |
| JP | 07-092490 | | 4/1995 |
| JP | 8-327822 | | 12/1996 |
| JP | 9-138421 | | 5/1997 |
| JP | 9-185037 | | 7/1997 |
| JP | 09-258169 | | 10/1997 |
| JP | 11-295739 | | 10/1999 |
| JP | 11-352450 | | 12/1999 |
| JP | 2000-019486 | A | 1/2000 |
| JP | 2000-105575 | A | 4/2000 |
| WO | WO95/01701 | A | 1/1995 |
| WO | WO99/23636 | | 5/1999 |
| WO | WO99/53366 | A | 10/1999 |
| WO | WO00/14597 | A | 3/2000 |

OTHER PUBLICATIONS

"A wide-viewing-angle π cell compensated with a discotic film", Mori et al., The Institute of Electronics, Information and Communications Engineers, Technical Report of IEICE, EID98-144 (Jan. 1999), pp. 199-204.

"Response Time Improvement of TFT-LCDs by using Capacitively Coupled Driving" Takubo et al., LCD '95 Digest of technical papers, pp. 59-62.

* cited by examiner

OCB (normal drive) room femperature

| | [ms] | end gray scale 0 | 25 | 50 | 75 | 100 |
|---|---|---|---|---|---|---|
| start gray scale | 0 | – | 3.2 | 4.1 | 5.5 | 6.1 |
| | 25 | 0.92 | – | 3.5 | 5.5 | 6.2 |
| | 50 | 0.98 | 3.3 | – | 6.4 | 5.9 |
| | 75 | 0.9 | 2.9 | 6.1 | – | 6.4 |
| | 100 | 0.88 | 3.4 | 5.1 | 6.4 | – |

Fig. 12(a)

OCB (CC drive) 32℃

| | [ms] | end gray scale 0 | 25 | 50 | 75 | 100 |
|---|---|---|---|---|---|---|
| start gray scale | 0 | – | 2.2 | 2.0 | 2.3 | 2.9 |
| | 25 | 1.3 | – | 2.1 | 2.5 | 3.0 |
| | 50 | 0.6 | 0.8 | – | 2.5 | 3.0 |
| | 75 | 0.6 | 0.8 | 1.5 | – | 2.9 |
| | 100 | 0.7 | 0.9 | 1.6 | 2.5 | – |

Fig. 12(b)

TN (CC drive) 32℃

| | [ms] | end gray scale 0 | 25 | 50 | 75 | 100 |
|---|---|---|---|---|---|---|
| start gray scale | 0 | – | 6.9 | 7.4 | 7.9 | 10.9 |
| | 25 | 1.6 | – | 7.0 | 8.6 | 11.0 |
| | 50 | 1.8 | 6.0 | – | 8.2 | 11.3 |
| | 75 | 2.0 | 6.8 | 10.5 | – | 12.6 |
| | 100 | 3.1 | 8.8 | 16.5 | 23.2 | – |

Fig. 12(c)

OCB LIQUID CRYSTAL DISPLAY WITH ACTIVE MATRIX AND SUPPLEMENTAL CAPACITORS AND DRIVING METHOD FOR THE SAME

TECHNICAL FIELD

The present invention relates to a liquid crystal display and, more particularly to a liquid crystal display capable of performing high speed drive.

BACKGROUND ART

Conventionally, a TN (twisted nematic) liquid crystal display element has been generally used as a liquid crystal display. In actuality, since a TN liquid crystal display has a low response speed, an OCB (Optically Compensated Bend) display has been studied as a high-speed responsive liquid crystal display. See "Syadan Hojin Denki Tsushin Gattsukai Shingakugihou EDI98-144 P199" to know the detail of the OCB liquid crystal display.

In this OCB liquid crystal display, a liquid crystal is sandwiched between substrates and transparent electrodes are formed on inner surfaces of the substrates. Before power is turned ON, the liquid crystal has a spray orientation state. Then, when the power of the liquid crystal display is turned ON or the like, a relatively high voltage is applied to the transparent electrodes for a short time period to cause the liquid crystal to transition from the spray orientation state to a bend orientation state. In OCB liquid crystal display mode, the bend orientation state is employed for display, thereby enabling high speed response. By the way, problems associated with a HOLD-type display were pointed out in "Jyouhoukagakuyou Yuuki Zairyou 142th Iinkai A bukai (liquid crystal material) 71th Kenkyukai Bkai (intelligent organic material) 62nd Kenkyukai Shiryou Nov. 20, 1988, Nihongakujyutsu Shikoukai P 1-5", and techniques for displaying a moving picture in the liquid crystal display with performance equal to that of CRT (cathode ray tube) were suggested. The simplest one of these techniques is to write onto a picture at a high speed and insert a black picture on a periodic basis. Such a method for write onto the picture in a short time is generally referred to as "high speed drive" herein.

However, the OCB liquid crystal display is capable of performing high speed response but is unsatisfactorily performing high speed drive.

DISCLOSURE OF INVENTION

The present invention has been directed to solving the above-described problem and an object thereof is to provide a liquid crystal display capable of performing high speed drive.

To solve the above-described problem, there is provided a liquid crystal display comprising: a liquid crystal layer capable of bend orientation; a display screen on which an image is displayed by light transmitted through a bend-oriented liquid crystal layer; and liquid crystal voltage application means for applying a liquid crystal voltage to the liquid crystal layer according to luminance information for each field of image information composed of serial fields, the liquid crystal voltage being applied to cause transmittance of the light to change, thereby sequentially displaying the image corresponding to the fields of the image information on the display screen, wherein when the luminance information changes between current and subsequent fields, the liquid crystal voltage application means applies the liquid crystal voltage which changes so as to have a value according to the luminance information by the time the liquid crystal voltage is applied for the subsequent field.

With such a configuration, the voltage different from the voltage according to the luminance information of the image information is transiently applied to the liquid crystal. Thereby, the speed of change in the transmittance of the liquid crystal, i.e., the response speed, can be controlled in the OCB liquid crystal mode.

In this case, when the luminance information changes to cause the corresponding liquid crystal voltage to be increased, the liquid crystal voltage application means may apply the liquid crystal voltage which changes so as to have the value according to the luminance information after excessively increased, and when the luminance information changes to cause the corresponding liquid crystal voltage to be reduced, the liquid crystal voltage application means may apply the liquid crystal voltage which changes so as to have the value according to the luminance information after excessively reduced.

With such a configuration, since the transient voltage facilitates the change in the transmittance of the liquid crystal, the high speed response of the liquid crystal is achieved. In addition, since the variation of the amount of transmitted light with respect to the change in the dielectric constant of the liquid crystal is large in the OCB liquid crystal mode, the response speed is much more improved than that of the conventional OCB liquid crystal mode by synergism of this effect and the effect of the transient voltage application. Consequently, this liquid crystal display is capable of performing "high speed drive".

The liquid crystal voltage may converge to the value according to the luminance information after excessively increased or reduced.

Thereby, the liquid crystal voltage easily transitions to the voltage according to th luminance information of the image information.

The display screen may be composed of a plurality of pixels and the liquid crystal display voltage application means may comprise pixel voltage application means for sequentially applying a pixel voltage to the liquid crystal layer of all the pixels according to the luminance information for each pixel in the field.

Thereby, in the liquid crystal display having the display screen composed of the plurality of pixels, the liquid crystal voltage can be changed.

The liquid crystal display may further comprise gate drive means for sequentially scanning the plurality of pixels through a gate electrode; source drive means for applying a base voltage based on the luminance information of the pixels of the image information to the liquid crystal layer of the pixels sequentially scanned, through a source electrode; and compensation voltage application means for applying a compensation voltage to the pixels through capacitive coupling after the pixels are scanned such that the compensation voltage is overlapped with the base voltage, and the source drive means and the compensation voltage application means may constitute the pixel voltage application means such that the base voltage and the compensation voltage change as the pixel voltage, according to change in a liquid crystal capacitor of the pixels.

Thereby, since the source drive means capable of applying the voltage only during the scanning by the gate drive means is adapted to apply a constant base voltage, the compensation voltage is overlapped with the base voltage by utilizing the capacitive coupling during the period after scanning in which the pixel voltage is to be changed, and the resulting overlapped voltage changes so as to have the value according to the luminance information of the pixels due to the change in a capacity for the liquid crystal capacitor, the transient voltage according to the luminance information of the pixels can be automatically applied. That is, the transient voltage can be applied in a simplified manner.

The capacitive coupling may be formed between the pixel electrode and a preceding gate electrode in the order in which the pixels are scanned.

Thereby, since the compensation voltage can be applied by using the gate electrode, the configuration of the compensation voltage application means can be simplified.

The gate drive means may be adapted to cause the preceding gate electrode to vary a potential thereof in order to apply the compensation voltage.

The capacitive coupling may be formed between the pixel electrode and a dedicated capacitor line.

The compensation voltage may be applied by varying a potential of the capacitor line.

The liquid crystal voltage application means may comprise a voltage supply source for supplying the liquid crystal voltage only through a signal line through which the voltage based on the luminance information for each field of the image information is applied to the liquid crystal layer.

Thereby, the waveform of the transient voltage can be easily controlled.

The voltage supply source may comprise means for storing the image information of the current and subsequent fields; means for deriving change in the luminance information between the fields of the stored image information; means for generating the compensation voltage according to change in the derived luminance information; and liquid crystal voltage supply means for generating the base voltage based on the luminance information of the subsequent field, overlapping the compensation voltage with the base voltage, and outputting the overlapped voltage as the liquid crystal voltage.

In this case, an image information write period during which the image information of one field is sequentially written to all the pixels may occupy less than 90% of a field period corresponding to a predetermined cycle in which the image information of one field is written.

Thereby, the sharpness of the displayed moving picture can be improved by the insertion of the black picture in the field period.

The image information write period may be less than 16.6 ms.

Thereby, in a moving picture display system of a field frequency of 60 Hz generally adopted, the liquid crystal display can improve the sharpness of the displayed moving picture by the insertion of the black picture.

In this case, the image information write period may occupy less than half of the field period.

Also, the image information write period may be less than 8 ms.

Thereby, since this liquid crystal display is capable of performing "double speed drive" and can display the sharp moving picture by the insertion of the black picture in the moving picture display system of the field frequency of 60 Hz generally adopted, the liquid crystal display can be practically used in the television, monitor, or the like in terms of the response speed.

The pixel voltage application means may be adapted to apply a pixel voltage to display a substantially black picture on the display screen during a period of the field period except the image information write period.

Thereby, the sharpness of the moving picture can be improved.

The liquid crystal display may further comprise: a lighting device including a light source for supplying light transmitted through the liquid crystal layer and control means for controlling the light source to be tuned on during the image information write period of the field period and to be turned off during the remaining period.

Thereby, since the display screen is dark while the light source is OFF, the sharpness of the moving picture can be improved.

In this case, a ratio of a capacity for the capacitive coupling to the capacity for the liquid crystal capacitor of the pixel may be 0.7 or more.

Thereby, since the change in the pixel voltage due to the change in the capacity for the liquid crystal capacitor is large, the transient voltage can be made higher. Consequently, the high speed response of the liquid crystal can be achieved.

In this case, the ratio of the capacity for the capacitive coupling to the capacity for the liquid crystal capacitor of the pixel may be 1 or more.

Thereby, since the transient voltage can be made higher, the high speed response of the liquid crystal can be achieved.

Also, in this case, a maximum level of the pixel voltage and a minimum level of the pixel voltage respectively may correspond to upper and lower limit levels of the luminance information of the image information and a ratio of dielectric constant of the liquid crystal layer under the minimum level to dielectric constant of the liquid crystal layer under the maximum level may be 1.2 or more.

Thereby, since the change in the capacity for the liquid crystal capacitor occurring when the luminance information of the image information changes is large, the high speed response of the liquid crystal can be achieved.

The ratio of dielectric constant may be 1.4 or more.

Thereby, the higher response speed of the liquid crystal can be achieved.

The dielectric constant anisotropy of the liquid crystal layer may be 6.5 or more.

Thereby, the change in the dielectric constant of the liquid crystal occurring when the luminance information of the image information changes is increased according to the dielectric constant anisotropy and "high speed drive" is possible when the dielectric constant anisotropy is 6.5 or more.

The dielectric constant anisotropy of the liquid crystal layer may be 7.7 or more.

Thereby, higher response speed of the liquid crystal can be achieved.

According to the present invention, there is also provided a liquid crystal display comprising: a liquid crystal layer capable of bend orientation; a display screen composed of a plurality of pixels on which an image is displayed by light transmitted through a bend-oriented liquid crystal layer; and pixel voltage application means for sequentially applying a pixel voltage to the liquid crystal layer of all the pixels according to luminance information for each pixel of image information, the pixel voltage being applied to cause transmittance of the light to change, thereby displaying the image corresponding to the image information on the display screen, and the pixel voltage application means is adapted to apply an offset voltage forming the pixel voltage together with a voltage applied to the liquid crystal layer of the pixels during the sequential application through capacitive coupling after the sequential application to prevent backward transition from bend orientation to spray orientation of the liquid crystal layer.

With this configuration, the offset voltage can be applied without limiting an available size of the liquid crystal panel depending on the charging capacity of the liquid crystal panel, although the application of the offset voltage by the change of the counter voltage limits the available size of the liquid crystal panel depending on the charging capacity of the liquid crystal panel. Also, since the pixel voltage transiently changes, the offset voltage can be applied by utilizing the CC drive. Therefore, the liquid crystal display can realize very high speed response and simplify the configuration to apply the offset voltage.

The liquid crystal display may further comprise: gate drive means for sequentially scanning the plurality of pixels through a gate electrode, and the pixel voltage application means may include source drive means for applying a base voltage based on the luminance information of the pixels of the image information to the liquid crystal layer of the pixels sequentially scanned, through a source electrode; and offset voltage application means for applying an offset voltage forming the pixel voltage together with the base voltage to the pixel through the capacitive coupling after the pixels are scanned, and the capacitive coupling may be formed between the pixel electrode and a preceding gate electrode in the order in which the pixels are scanned.

Thereby, since the offset voltage can be applied by utilizing the gate electrode, the configuration of the offset voltage application means can be simplified.

The capacitive coupling may be formed between a pixel electrode and a dedicated capacitor line.

The offset voltage may be 1 v or more.

Thereby, in the general OCB liquid crystal panel, the backward transition from the bend orientation to the spray orientation can be prevented.

The offset voltage may be greater than a voltage at which the liquid crystal layer transitions backward from the bend orientation to the spray orientation.

Thereby, the backward transition from the bend orientation to the spray orientation can be prevented.

In this case, a substantially black picture may be displayed on the display screen in a field period corresponding to a predetermined cycle in which the image information of one field is written.

Thereby, the required offset voltage can be reduced and the sharpness of the moving picture can be improved.

The display screen may be substantially rectangular and have a diagonal line having a length of 10 inches or more.

Thereby, in the liquid crystal display of this size, the offset voltage can be applied advantageously by the configuration of this embodiment.

The diagonal line may have a length of 15 inches or more.

Thereby, in the liquid crystal display of this size, the offset voltage can be applied only by using the configuration of the present invention.

According to the present invention, there is further provided liquid crystal display comprising: a liquid crystal layer capable of bend orientation; a display screen composed of a plurality of pixels on which an image is displayed by light transmitted through a bend-oriented liquid crystal layer; and a pixel voltage application means, the pixel voltage being applied to cause transmittance of the light to change, thereby displaying the image corresponding to the image information on the display screen, and the liquid crystal layer of the pixels transitions to bend orientation by using a voltage applied to the liquid crystal layer of the pixels through capacitive coupling.

With such configuration, in addition to the normal voltage applied by the pixel voltage application means, the voltage applied through the capacitive coupling can be used as the transition voltage. Therefore, the liquid crystal can transition in a short time.

The liquid crystal display may have an inactive period during which no voltage is applied to the liquid crystal layer of the pixels, prior to the transition.

Thereby, since no voltage is applied to the liquid crystal layer before transition, the preferable transition can take place.

The liquid crystal display may further comprise: gate drive means for sequentially scanning the plurality of pixels through a gate electrode; and the pixel voltage application means may comprise source drive means for applying a base voltage based on the luminance information of the pixels of the image information to the liquid crystal layer of the pixels sequentially scanned, through a source electrode, and a cumulated voltage application means for applying a cumulated voltage forming the pixel voltage together with the base voltage to the pixels through the capacitive coupling after the pixels are scanned, and the cumulated voltage may be used to cause the liquid crystal layer of the pixels to transition to bend orientation.

With this configuration, by transiently changing the pixel voltage, the cumulated voltage by the CC drive can be used as part of the transition voltage. Therefore, the liquid crystal display can realize very high speed response and reduce the transition time.

The capacitive coupling may be formed between the pixel electrode and a preceding gate electrode in the order in which the pixels are scanned.

Thereby, since the cumulated voltage can be applied by using the gate electrode, the configuration of the cumulated voltage application means can be simplified.

The capacitive coupling may be formed between a pixel electrode and a dedicated capacitor line.

The gate drive means as the cumulated voltage application means may be adapted to apply the cumulated voltage to the respective pixels while sequentially scanning all the pixels during the transition.

Thereby, the gate drive means can operate in the same mode during transition and during display.

The source drive means may be adapted to output an alternating current base voltage having a transition voltage value, and the gate drive means may be adapted to output a gate signal having two voltage levels at which a switching element provided for each pixel is placed in a conductive state when the pixel is scanned and is placed in a cut-off state when the pixel is not scanned, during the inactive period, and output a gate signal having two voltage levels at which the cumulated voltage having a polarity according to a polarity of the base voltage just after the pixel is scanned, in addition to the two voltage levels, during the transition period.

Thereby, the cumulated voltage can be applied to the liquid crystal of the pixels during transition, and is prevented from being generated during the inactive period. Consequently, transition can take place preferably and in a short time.

The source drive means may be adapted to output a direct current base voltage having a transition voltage value, the gate drive means may be adapted to output a gate signal having two voltage levels at which a switching element provided for each pixel is placed in a conductive state when the pixel is scanned and is placed in a cut-off state in which the pixel is not scanned, during the inactive period, and output a gate signal having one voltage level at which the cumulated voltage having a polarity identical to a polarity of the base voltage can be applied just after the pixel is scanned, in addition to the two voltage levels, during the transition period.

Thereby, since the cumulated voltage has one polarity, it can be generated with high efficiency.

According to the present invention, there is still further provided a liquid crystal display comprising: a twisted nematic mode liquid crystal layer; a display screen on which an image is displayed by light transmitted through the liquid crystal layer; and a liquid crystal voltage application means for applying a liquid crystal voltage to the liquid crystal layer according to luminance information for each field of image information composed of serial fields, the liquid crystal voltage being applied to cause transmittance of the light to change, thereby sequentially displaying the image corresponding to the fields of the image information, on the display screen, and the liquid crystal voltage application means may apply the liquid crystal voltage which changes so as to have a value according to the luminance information by the time the liquid crystal voltage is applied for the subsequent field when the luminance information changes between current and subsequent fields, the liquid crystal voltage changing so as to have a value according to the luminance information after excessively increased when the luminance information changes to cause the corresponding liquid crystal voltage to be increased, and the liquid crystal voltage changing so as to have a value according to the luminance information after excessively reduced when the luminance information changes to cause the corresponding liquid crystal voltage to be reduced, and the liquid crystal layer has a thickness of 3 μm or less.

Thereby, high speed response of the liquid crystal can be achieved because the large electric field is generated in the liquid crystal layer. As a result, since this liquid crystal display is capable of performing "double speed drive" and displays the sharp moving picture by the insertion of the black picture in the moving picture display system of the field frequency of 60 Hz generally adopted, this can be used practically in the television, monitor, or the like in terms of the response speed.

These objects as well as other objects, features and advantages of the invention will become apparent to those skilled in the art from the following description with reference to the accompanying drawings.

BRIEF DESCRIPTION OF DRAWINGS

FIGS. 12(*a*)-12(*c*) are tables showing Rise time and Decay time between gray scales, wherein FIG. 12(*a*) shows a table for the OCB liquid crystal mode of normal drive, FIG. 12(*b*) shows a table for the OCB liquid crystal mode of CC drive, and FIG. 12(*c*) shows a table for TN liquid crystal mode of the CC drive;

BEST MODE FOR CARRYING OUT THE INVENTION

Hereinafter, embodiments of the present invention will be described with reference to drawings.

First Embodiment

Figure 1:
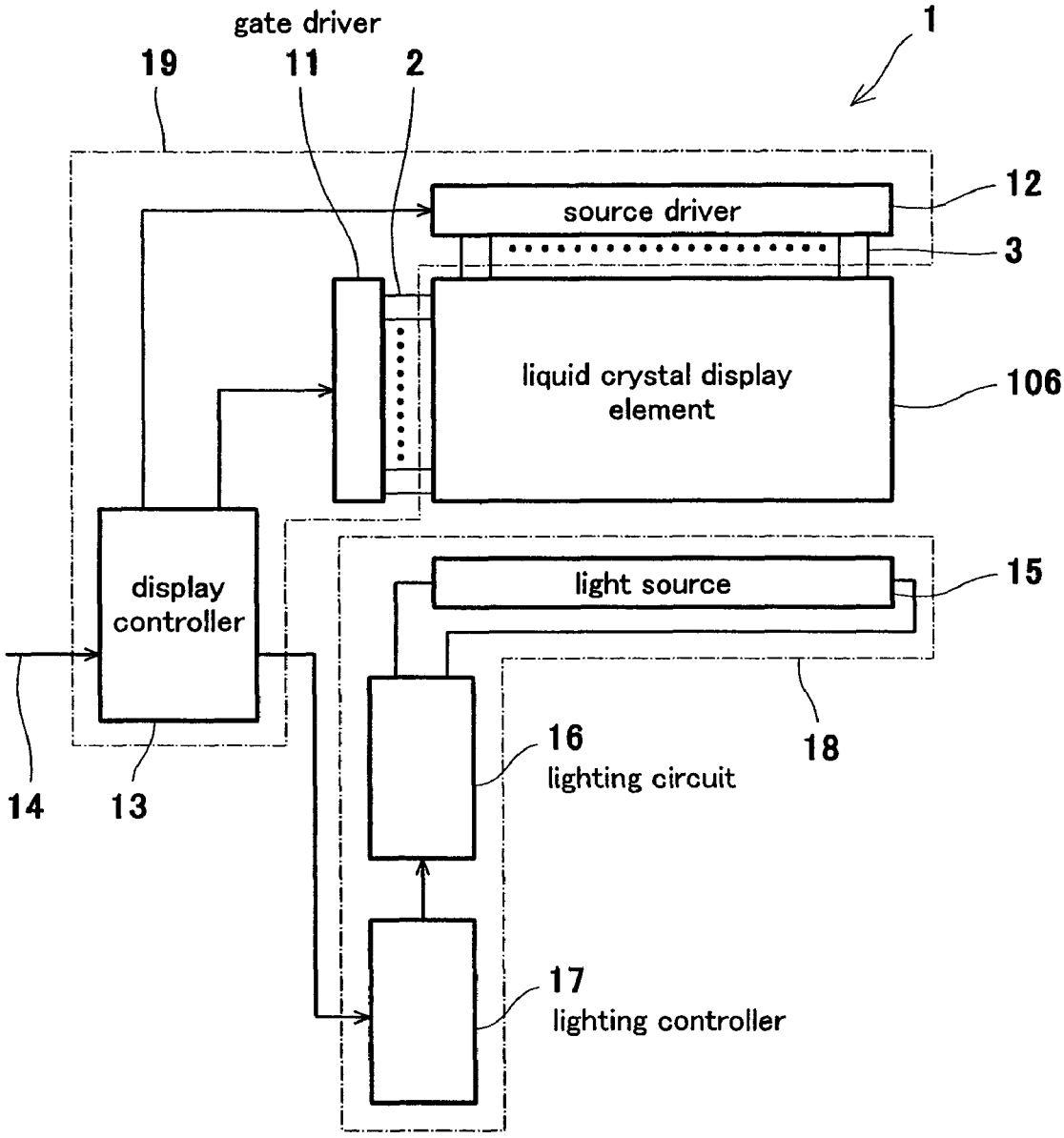
FIG. 1 is a block diagram showing a structure of a liquid crystal display according to a first embodiment of the present invention.
Figure 2:
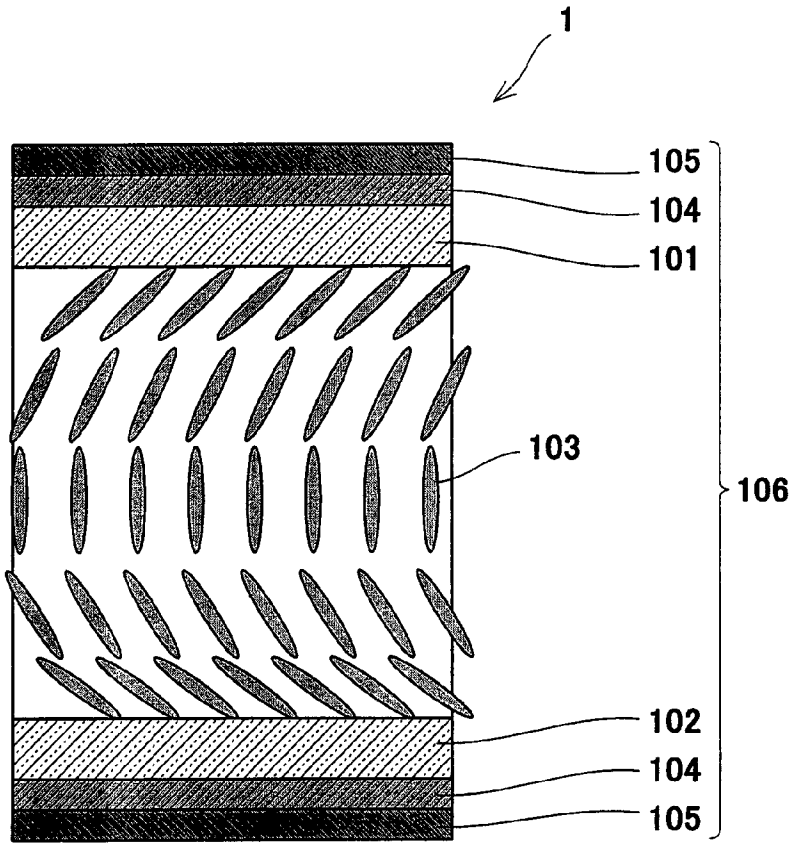
FIG. 2 is a cross-sectional view schematically showing a structure of the liquid crystal display of FIG. 1.
Figure 3:
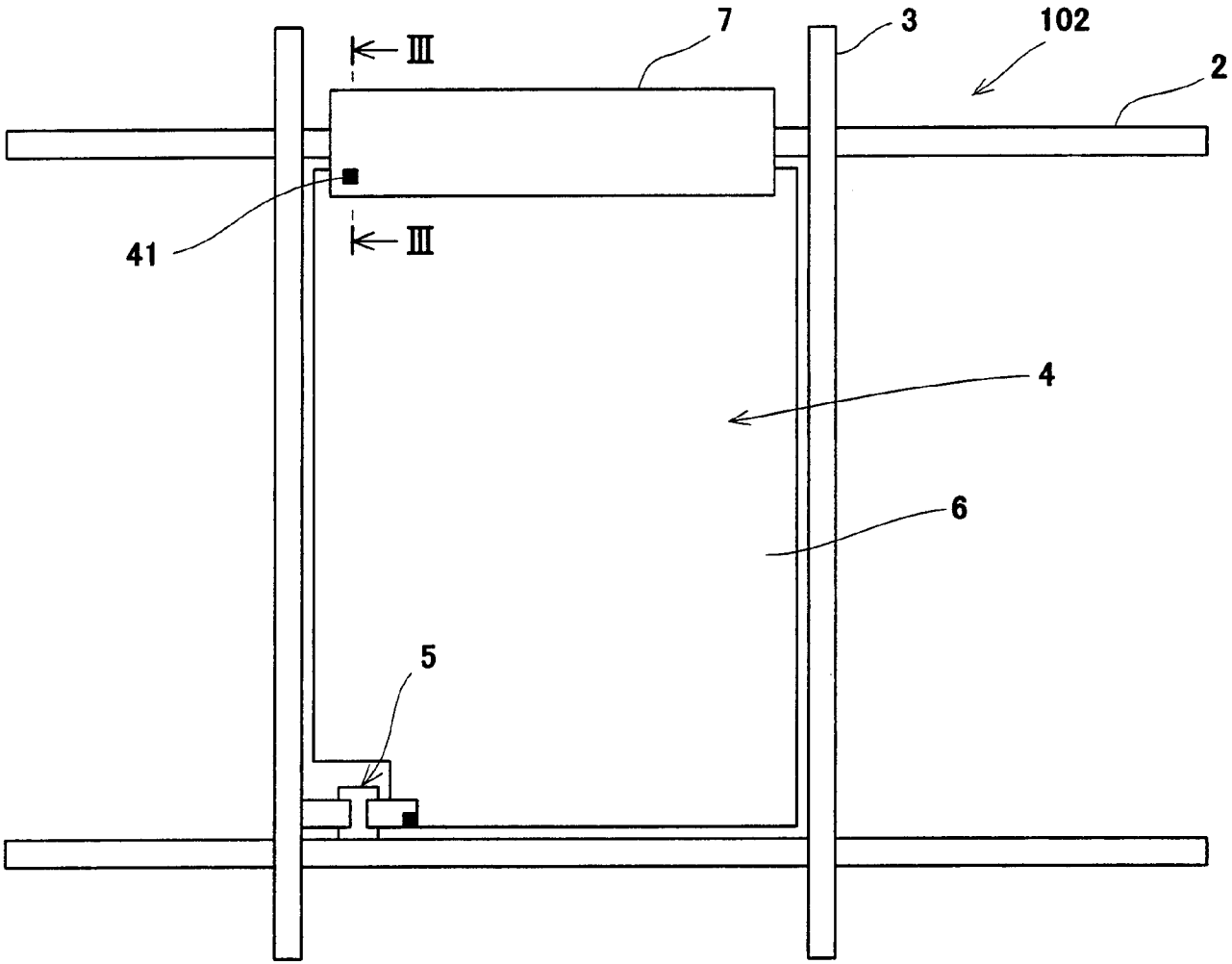
FIG. 3 is a plan view schematically showing a structure of a pixel of a liquid crystal display element of FIG. 1.
Figure 4:
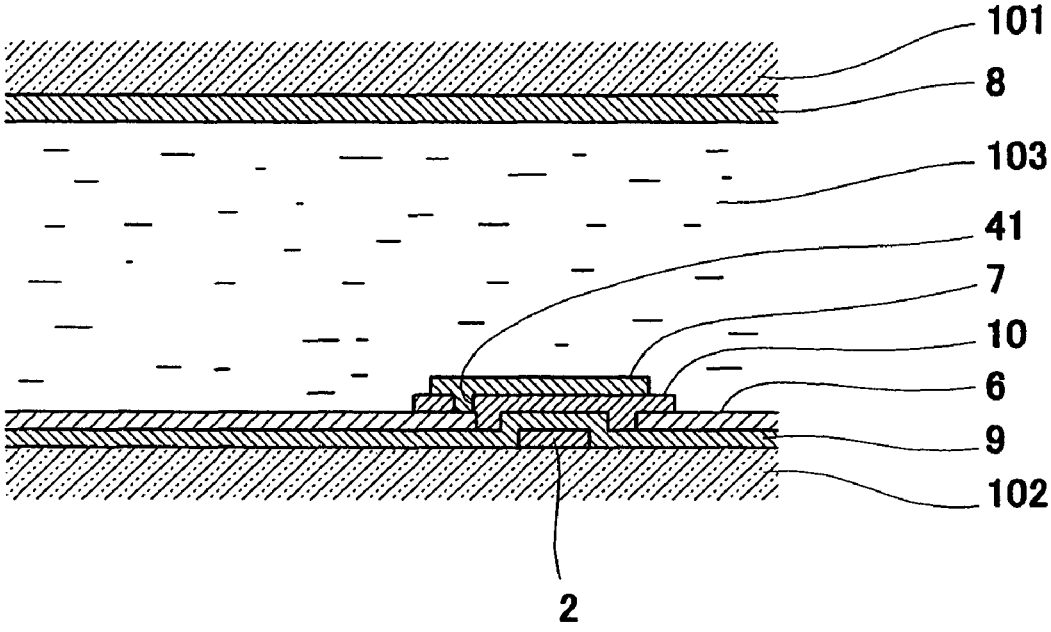
FIG. 4 is a cross-sectional view showing a structure of a storage capacitor electrode.
Figure 5:
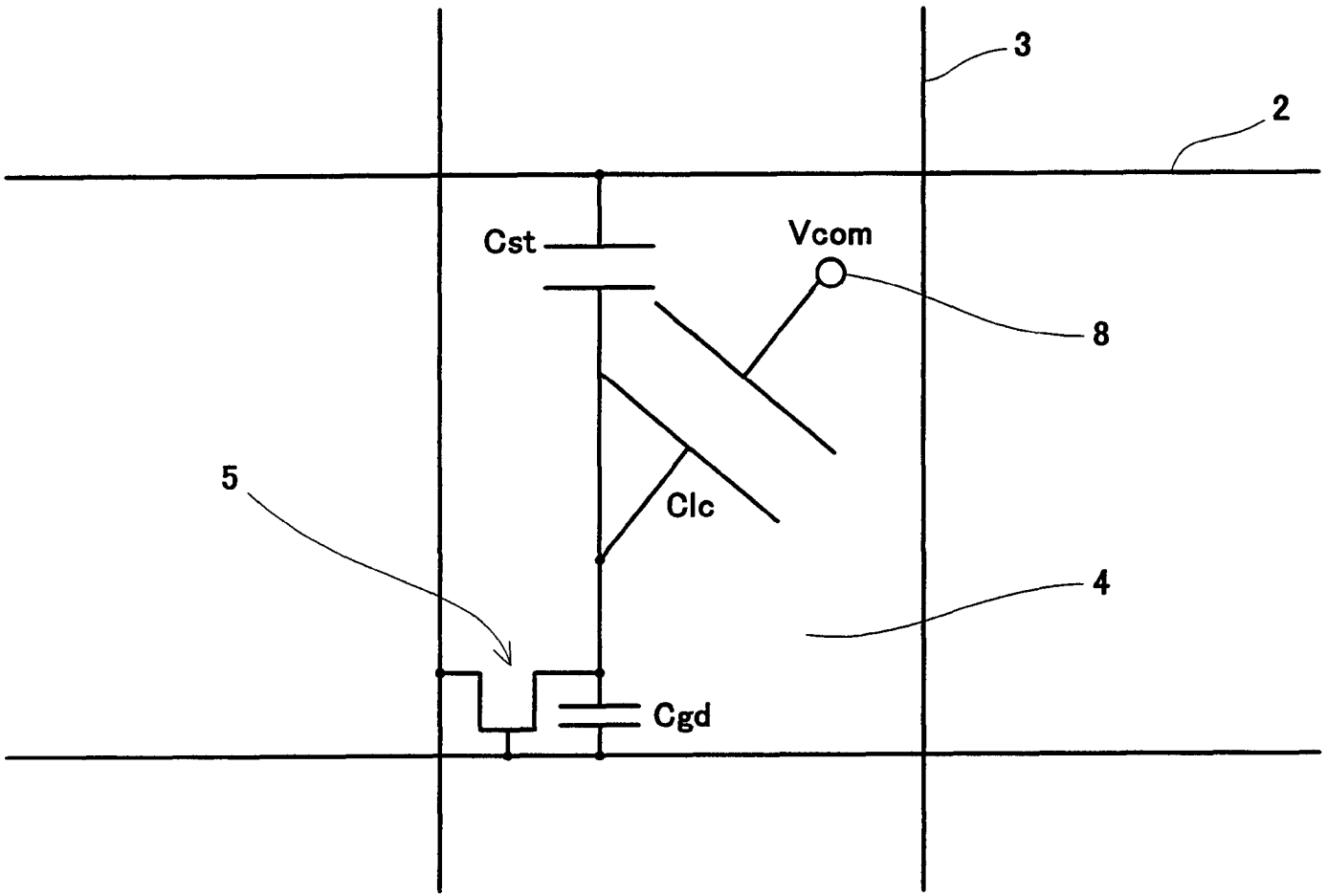
FIG. 5 is a circuit diagram showing an equalization circuit of the pixel.

FIG. 1 is a block diagram showing a structure of a liquid crystal display according to a first embodiment of the present invention, FIG. 2 is a cross-sectional view schematically showing a structure of the liquid crystal display of FIG. 1, FIG. 3 is a plan view schematically showing a structure of a pixel of a liquid crystal display element of FIG. 1, FIG. 4 is a cross-sectional view showing a structure of a storage capacitor electrode, and FIG. 5 is a circuit diagram showing an equalization circuit of the pixel.

Referring now to FIG. 1, a liquid crystal display 1 comprises a liquid crystal display element (liquid crystal panel)

106, a backlight 18, and a display control circuit 19. In the liquid crystal display 1, the backlight 18 is adapted to supply display light to the liquid crystal display 106 and the display control circuit 19 is adapted to drive the liquid crystal display element 106 to transmit the display light according to a video signal 14. Thereby, an image according to the video signal 14 is displayed on the liquid crystal display element 106.

The backlight 18 is adapted to supply the display light to the liquid crystal display element 106 via a light guide plate (not shown) from a light source 15 driven by a lighting circuit 16.

The display control circuit 19 comprises a display controller 13, a gate driver 11, a source driver 12, and a lighting controller 17. The display controller 13 is adapted to output control signals to the gate driver 11, the source driver 12, and the lighting controller 17, according to the video signal 14, respectively. In accordance with the control signal, the gate driver 11 is adapted to output a gate signal through a gate electrode 2, thereby sequentially scanning (selecting) a pixel of the liquid display element 106 for each gate electrode 2. In accordance with the control signal, the source driver 12 is adapted to output a source signal according to the timing of the gate signal, thereby sequentially writing the source signal to the scanned pixel through a source electrode 3. Thereby, transmittance of each pixel with respect to the display light is varied according to the source signal. Consequently, an image according to the video signal 14 is displayed on the liquid display element 106. The lighting controller 17 serves to control the lighting circuit 16 to drive the light source 15 in accordance with the control signal from the display controller 13.

Referring to FIG. 2, the liquid crystal display element 106 is of an active matrix type, and is structured such that a liquid crystal 103 is sandwiched between a counter substrate 101 and a TFT (thin film transistor) substrate 102 placed opposite to each other and a retardation film 104 and a polarizer 105 are disposed on outside of each of the substrates 101, 102 in this order. A counter electrode 8 (see FIG. 4) is formed on an inner surface of the counter substrate 101 and an alignment layer (not shown) is formed on a surface of the counter electrode 8. Referring to FIG. 3, the gate electrode 2, the source electrode 3, the pixel electrode 6, and the like are formed on the inner surface of the TFT substrate 102, which are covered by an alignment layer (not shown). The alignment layers of the substrates 102, 102 have been subjected to rubbing treatment such that rubbing directions thereof are parallel to each other. FIG. 2 shows a cross-section parallel to the rubbing directions. A nematic liquid crystal is used as the liquid crystal. In other words, the liquid crystal display element 106 employs an OCB liquid crystal mode. In the OCB liquid crystal mode, in an initial state in which no voltage is applied on the liquid crystal, the liquid crystal has a spray orientation in which liquid crystal molecules are arranged so as to be substantially parallel with one another, and upon application of a relatively high voltage, for example, a voltage of approximately 25V, the liquid crystal transitions to the bend orientation as a display state. FIG. 2 shows this bend orientation.

As shown in FIG. 3, a plurality of linear gate electrodes 2 and a plurality of linear source electrodes 3 are formed on the inner surface of the TFT substrate 102 such that the electrodes 2 are orthogonal to the electrodes 3, and a region defined in matrix by the electrodes 2 and the electrodes 3 corresponds to a pixel 4. All the pixels 4 compose a region corresponding to a display screen (not shown). The pixel electrode 6 and a switching element 5 comprising TFT (thin film transistor) are formed for each pixel 4. The switching element 5 has source and drain respectively connected to the source electrode 3 and the pixel electrode 6 and gate connected to the gate electrode 2. The gate signal is sequentially output to the gate electrode 2 downwardly from above in FIG. 3, thereby causing the pixel connected to the gate electrode 2 to be sequentially scanned for each gate electrode 2. Hereinafter, "preceding, current, and subsequent" refer to the order in which the pixel is scanned. In each pixel 4, a storage capacitor electrode 7 is capacitively coupled to the preceding gate electrode 2 and connected to the pixel electrode 6. In other words, the liquid crystal display element 106 employs so-called a capacitive coupling drive method (hereinafter referred to as CC drive). See Japanese Laid-Open Patent Publication No. Hei. 2-157815 or AM-LCD 95 Digest of Technical papers, 59 page, to know the detail of the CC drive. Specifically, as shown in FIG. 4, the gate electrode 2 is formed on the TFT substrate 102 and an insulating layer 9 covers the surface of the TFT substrate 102 provided with the gate electrode 2, the pixel electrode 6 covers a portion of the insulating film 9 that is situated in the pixel, and an insulating layer 10 covers a portion of the insulating layer 9 that is situated on the gate electrode 2 and a peripheral portion of the pixel electrode 6 that is adjacent to the gate electrode 2. The storage capacitor electrode 7 is formed on the insulating layer 10 and connected to the subsequent pixel electrode 6 via a contact hole 41. With such a structure, as shown in FIG. 5, the equalization circuit of the pixel 4 is configured such that one main terminal of the switching element 5 is connected to the source electrode 3 and the other terminal of the switching element 5 is connected to the counter electrode 8 via a liquid crystal capacitor Clc and to the preceding gate electrode 2 via a storage capacitor Cst. Cdg denotes stray capacitor between the pixel electrode 6 and the gate electrode 2.

Subsequently, an operation of the liquid crystal display 1 so structured will be explained.

Figure 6:
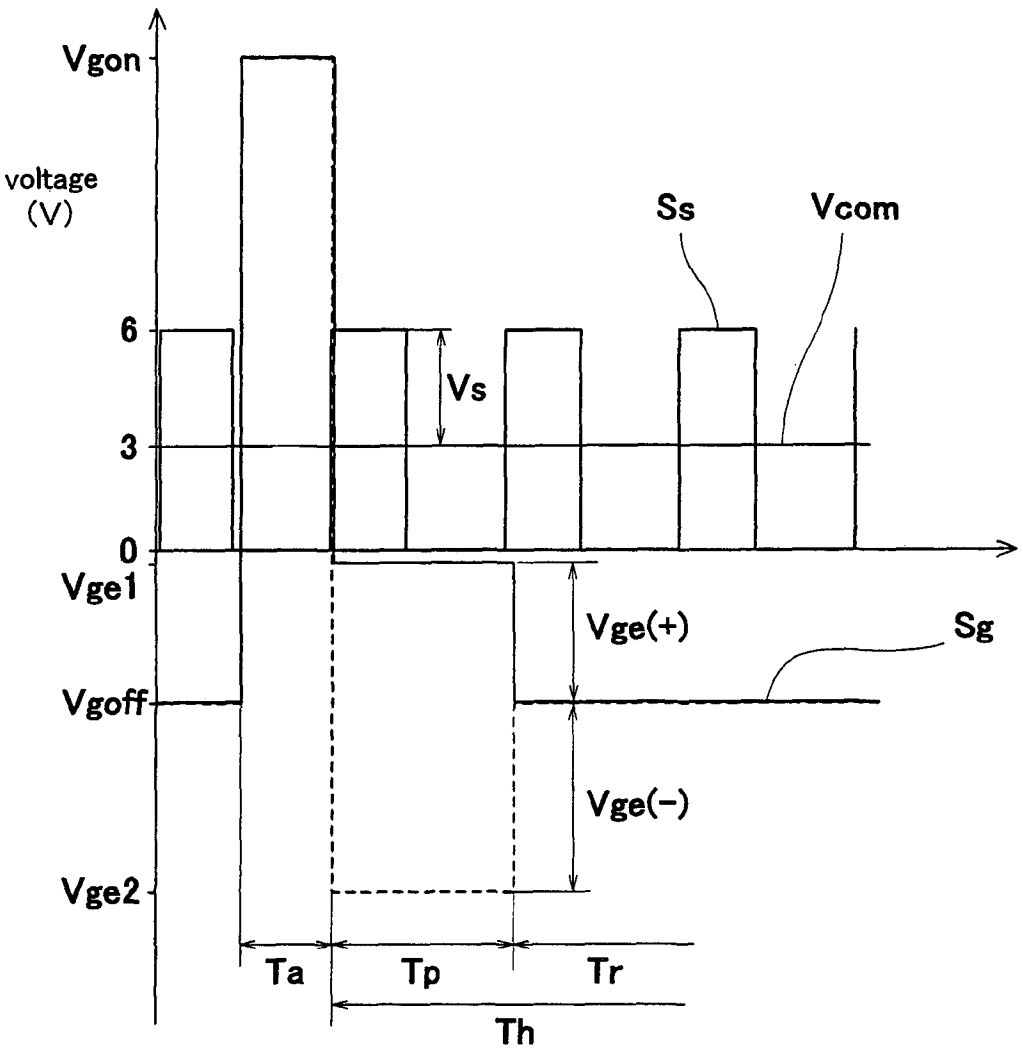
FIG. 6 is a graph showing a gate signal, a source signal, and a counter voltage.
Figures 7A, 7B:
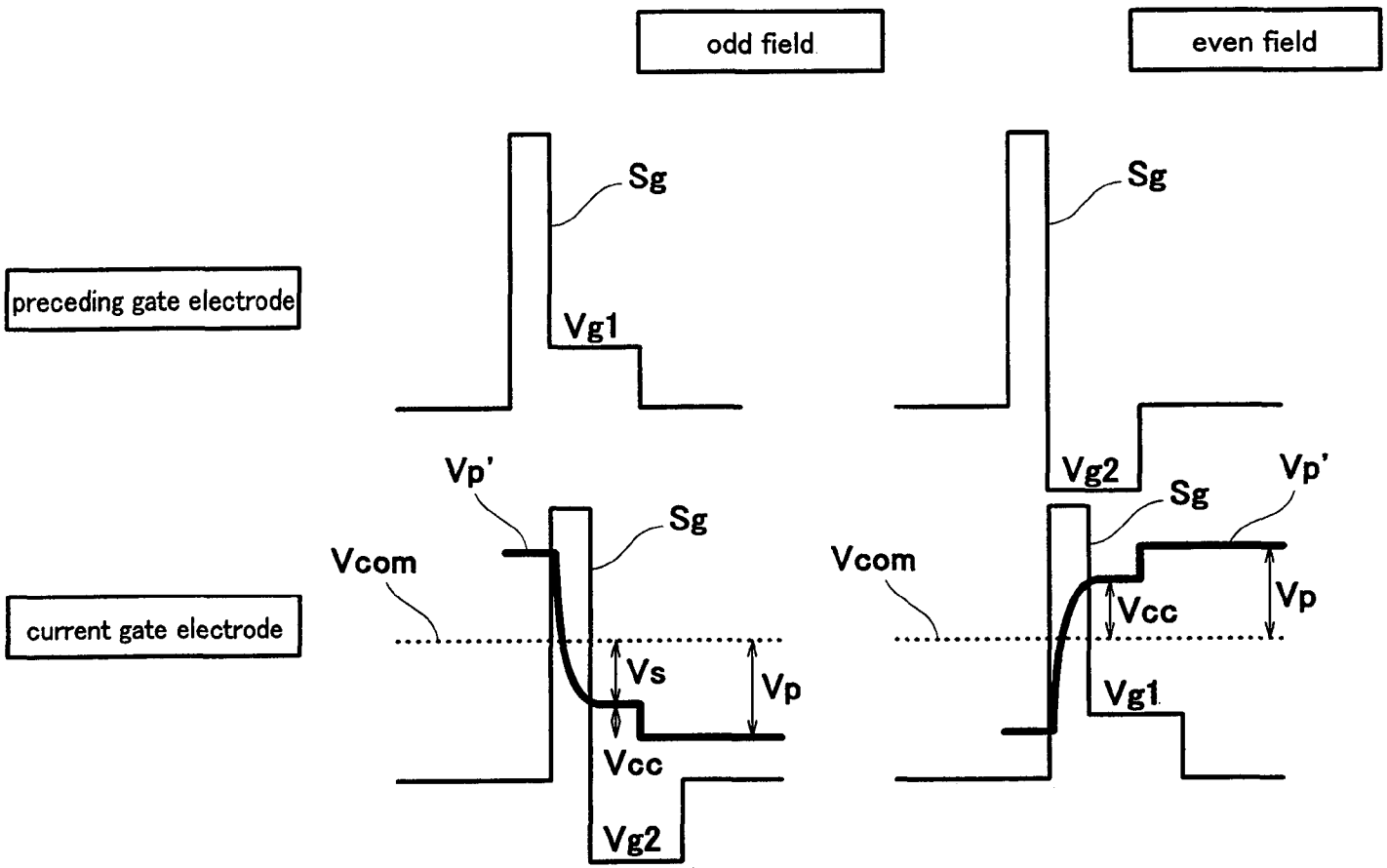
FIGS. 7(*a*), 7(*b*) are graphs showing the relationship between change in the gate signal and change in the source signal, wherein FIG. 7(*a*) shows the change in an odd field and FIG. 7(*b*) shows the change in an even field.

FIG. 6 is a graph showing the gate signal, the source signal, and potential of the counter voltage, and FIGS. 7(*a*), 7(*b*) are graphs showing the relationship between change in the gate signal and change in the pixel voltage, wherein FIG. 7(*a*) shows the change in a odd field and FIG. 7(*b*) shows the change in an even field.

As shown in FIGS. 1, 6, the potential of the counter electrode (hereinafter referred to as a counter voltage) Vcom is set to a fixed value. The liquid crystal display element 106 is AC (alternating current) driven. That is, with respect to the counter voltage Vcom, the source driver 12 outputs a source signal Ss that alternately takes a positive or negative value for each pixel connected to the source electrode. The source signal Ss has a polarity inverted with respect to the counter voltage Vcom picture by picture, i.e., field by field. In this embodiment, the counter voltage Vcom is set to 3V. The source signal Ss has an amplitude (base voltage) Vs set to 3V, and therefore alternately takes 6V and OV.

The gate driver 11 outputs a gate signal Sg described b low. The gate signal Sg has a voltage of Vgon in a write period Ta, Vge1 in the odd field and Vge2 in the even field in a cumulating period Tp subsequent to the write period Ta, and VgOff in the remaining period Tr other than the write period Ta and the cumulating period Tp. Vge1 is set higher than Vgoff by Vge(+) and Vge 2 is set lower than Vgoff by Vge(−). Vge1 as well as Vg2 is set to cause the switching element 5 to be placed in a cut-off state (high-resistance state). The cumulating period Tp is set more than twice as long as the write period Ta. In the gate signal Sg of this embodiment, Vgon is set to a predetermined positive value, Vgoff is set to −10V, Vge1 is set to −3V, Vge(+) is set to 7V, Vge 2 is set to −18V, and Vge(−) is set to −8V.

As shown in FIGS. 3, 7, in an arbitrary pixel, the switching element 5 is placed in a conductive state (low-resistance state) during the write period Ta, thereby causing the pixel electrode 6 to be charged by the voltage Vs of the source signal Ss. Thereby, the source signal Ss is written to the pixel 4. During this operation, in the odd field, a pixel voltage Vp' changes positive to negative, in which case, as shown in FIG. 7(*a*), when the source signal Ss is written to the pixel 4, Vge1 is applied to the preceding gate electrode 2 and the voltage lower than the voltage to be applied to the liquid crystal, i.e., a set pixel voltage Vp is applied to the pixel electrode 6. Then, in the cumulating period Tp, the voltage of the current gate electrode 3 is reduced to Vge2, thereby causing the switching element 5 to be placed in the cut-off state, whereas the voltage of the preceding gate electrode 3 is reduced to Vgoff by Vge(+). Since the switching element 5 is placed in the cut-off state and the pixel electrode 6 is coupled to the preceding gate electrode 3 via the storage capacitor Cst, the potential of the pixel electrode 6 is reduced in association with th voltage of the gate electrode 3. The change amount of the voltage (hereinafter referred to as compensation or cumulated voltage) Vcc has a value represented by the expression mentioned later.

In the even field, the pixel voltage Vp' changes negative to positive, in which case, as shown in FIG. 7(*b*), when the source signal Ss is written to the pixel 4, Vge2 is applied to the preceding gate electrode 2. Then, in the cumulating period Tp, the voltage of the current gate electrode 3 is reduced to Vge1, thereby causing the switching element 5 to be placed in the cut-off state, whereas the voltage of the preceding gate electrode 3 is increased to Vgoff by Vge(−). In association with the voltage of the gate electrode 3, the potential of the pixel electrode 6 is increased by the compensation voltage Vcc. In this case, the compensation voltage Vcc is represented by the following expression:

$$Vcc=Cst/(Cst+Cgd+Clc)\times(Vge(+) \text{ or } Vge(-))$$

In general, the voltage including the compensation voltage Vcc and to be applied to the pixel electrode 6 is expressed as:

$$Vp'=Vs+Vcc$$

The CC drive is defined as the method for driving the liquid crystal element described above. It is known that the use of the CC drive permits a higher response speed in the TN liquid crystal. This is due to dielectric constant anisotropy.

Here it is assumed that the transmittance of the liquid crystal display element (hereinafter simply referred to as transmittance) changes from 100% to 0% in an arbitrary pixel and the display mode is a normally white mode. When the transmittance is 100%, the voltage applied to the liquid crystal is low and the dielectric constant of the liquid crystal is small. Conversely, when the transmittance is 0%, the voltage applied to the liquid crystal is high and the dielectric constant is large.

Since the response of the liquid crystal molecules requires time longer than that of charging of the pixel electrode (write of source signal), it is delayed with respect to the charging of the pixel electrode.

The voltage Vp' applied to the pixel electrode (hereinafter referred to as pixel voltage) in an initial stage of charging of the pixel electrode, and more accurately, just after the end of the write period, is given by:

$$Vp'(\text{initial value})=Vs+Cst/(Cst+Cgd+Clc(100))\times Vge(+)$$

By the response of the liquid crystal, this changes as follows:

$$Vp'(\text{saturation value})=Vs+Cst/(Cst+Cgd+Clc(0))\times Vge(+)$$

Assuming that Clc(100) is a capacity for liquid crystal capacitor of transmittance=100% and Clc(0) is a capacity for liquid crystal capacitor of transmittance=0%, in this capacity for liquid crystal capacitor, the relationship between Clc(100) and Clc(0) is:

$$Clc(100)<Clc(0)$$

Therefore, the following relationship is established:

$$Vp'(\text{initial value})>Vp'(\text{saturation value})$$

In this case, Vp' (saturation value) corresponds to the voltage to be applied to the pixel electrode 6, i.e., the set pixel voltage Vp, which corresponds to luminance information (gray scale) for each pixel of the video signal.

Since the transmittance changes 100% to 0%, the voltage being applied to the liquid crystal correspondingly changes from low to high. During this change, a high voltage such as Vp' (initial value) is transiently applied to the liquid crystal in the initial stage of charging, thereby resulting in a higher response speed of the liquid crystal.

On the other hand, when a dark state with low transmittance changes to a relatively bright intermediate gray scale state with relatively high transmittance, the voltage being applied to the liquid crystal change from high to relatively low. In this case, since Vp' (initial value)<Vp' (saturation value), in the initial stage of charge, the low voltage of Vp' (initial value) is transiently applied to the liquid crystal. Consequently, also in this case, a higher response speed of the liquid crystal is achieved.

Subsequently, to clarify the characteristic of the present invention, comparison between the present invention and a normal drive method (hereinafter referred to as normal drive) will be explained.

Figure 8:
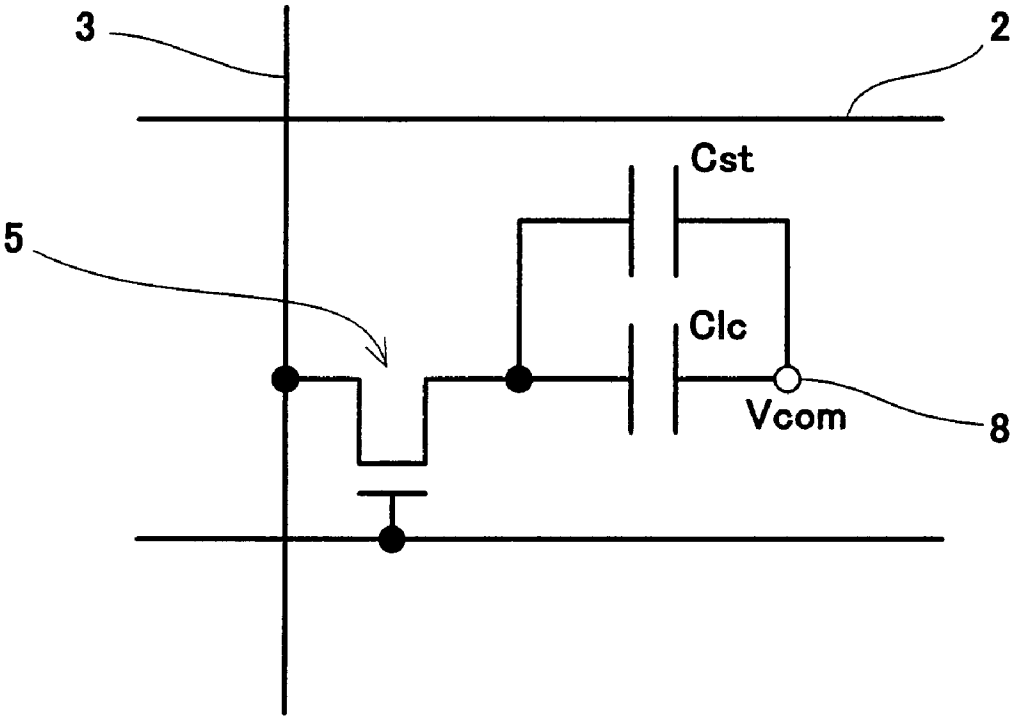
FIG. 8 is a circuit diagram showing the equalization circuit of the pixel in normal drive.
Figures 9A, 9B, 9C, 9D, 9E:
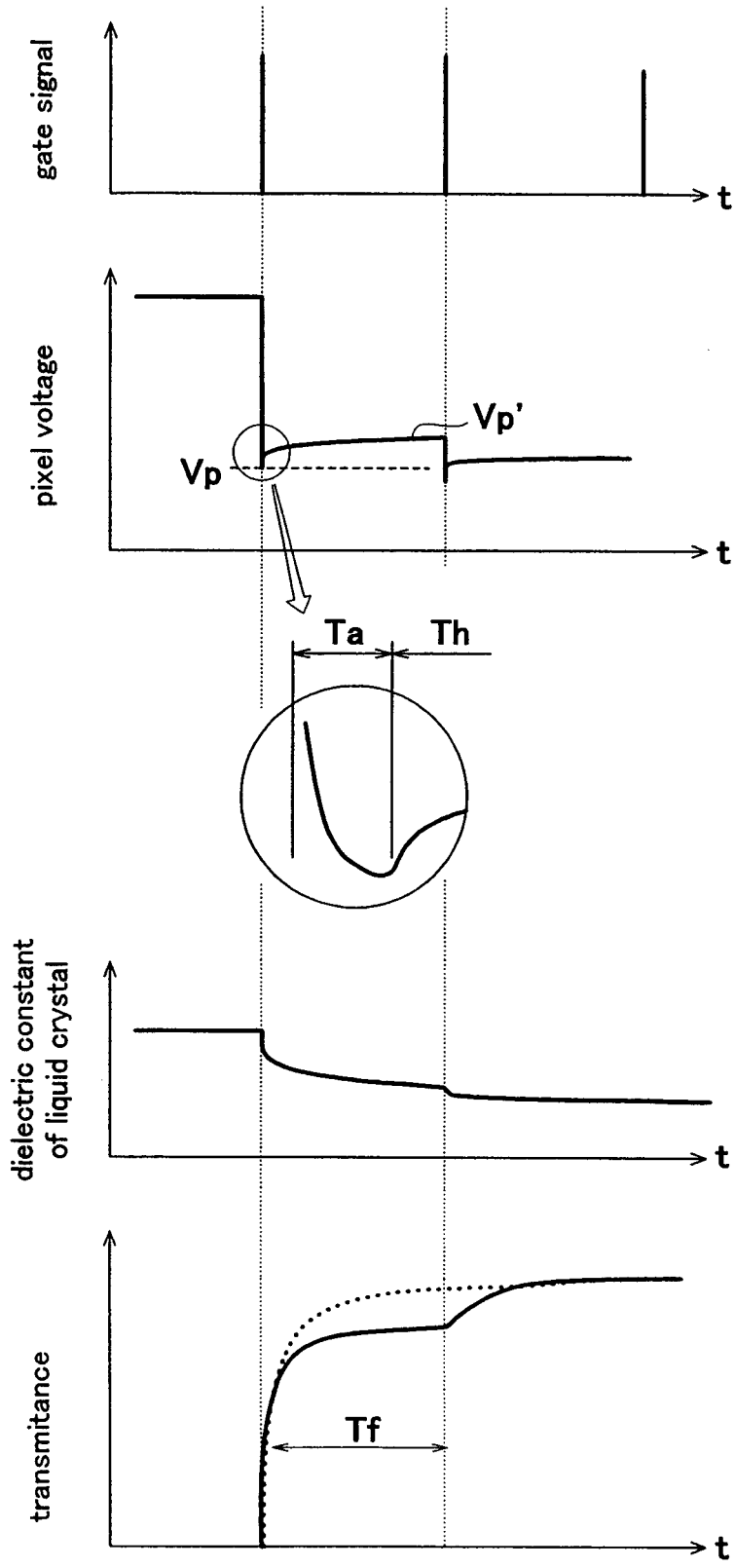
FIGS. 9(*a*)-9(*e*) are graphs for explaining change in transmittance of the pixel according to normal drive, wherein FIG. 9(*a*) shows the gate signal, FIG. 9(*b*) shows change in the pixel voltage, FIG. 9(*c*) shows change in the pixel voltage in transition from a write period to a hold period, FIG. 9(*d*) shows change in a dielectric constant of the liquid crystal in the pixel, and FIG. 9(*e*) shows change in transmittance of the pixel.
Figure 10A:
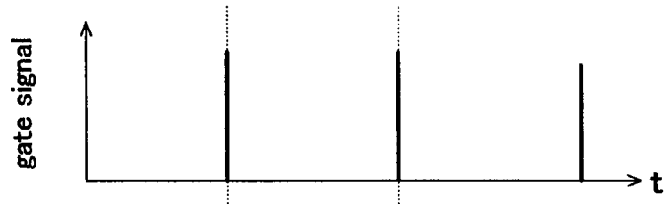
FIGS. 10(*a*)-10(*e*) are graphs for explaining change in transmittance of the pixel according to the first embodiment of the present invention, wherein FIG. 10(*a*) shows the gate signal, FIG. 10(*b*) shows change in the pixel voltage, FIG. 10(*c*) shows change in the pixel voltage in transition from a write period to a hold period, FIG. 10(*d*) shows change in a dielectric constant of the liquid crystal in the pixel, and FIG. 10(*e*) shows change in transmittance of the pixel.
Figure 10B:
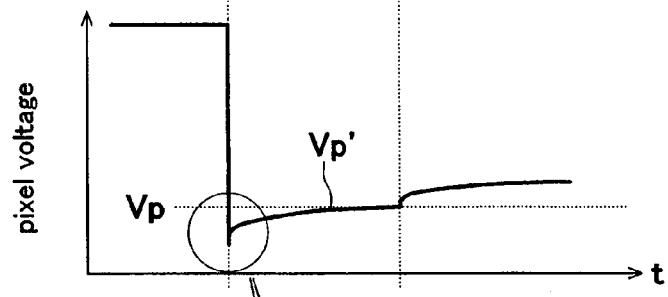
Figure 10C:
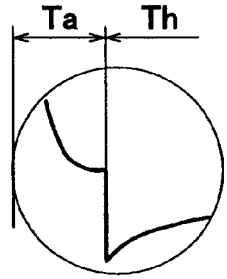
Figure 10D:
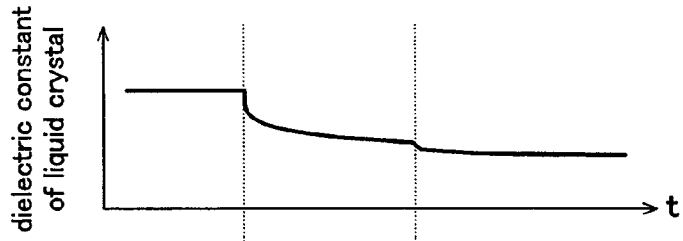
Figure 10E:
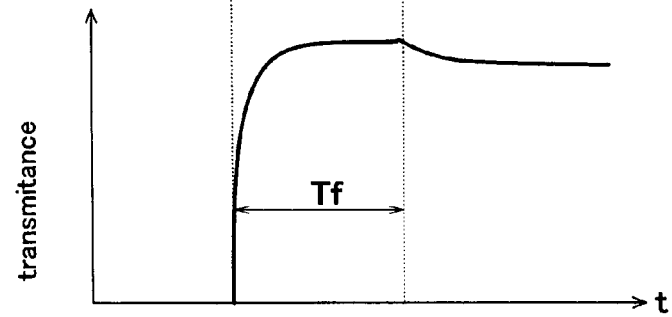

FIG. 8 is a circuit diagram showing an equalization circuit of the pixel in normal drive, FIGS. 9(*a*)-9(*e*) are graphs for explaining change in transmittance of the pixel according to normal drive, wherein FIG. 9(*a*) shows the gate signal, FIG. 9(*b*) shows change in the pixel voltage, FIG. 9(*c*) shows change in the pixel voltage in transition from a write period to a hold period, FIG. 9(*d*) shows change in a dielectric constant of the liquid crystal in the pixel, and FIG. 9(*e*) shows change in transmittance of the pixel. FIGS. 10(*a*)-10(*e*) are graphs for explaining change in transmittance of the pixel according to this embodiment, wherein FIG. 10(*a*) shows the gate signal, FIG. 10(*b*) shows change in the pixel voltage, FIG. 10(*c*) shows change in the pixel voltage in transition from a write period to a hold period, FIG. 10(*d*) shows change in the dielectric constant of the liquid crystal in the pixel, and FIG. 10(*e*) shows change in transmittance of the pixel.

As shown in FIG. 8, in the normal drive, the storage capacitor electrode is capacitively coupled to a capacitor line (not shown), which is connected to the counter electrode 8. As a result, the equalization circuit of the pixel is configured such that the storage capacitor Cst is connected to the liquid crystal capacitor Clc in parallel.

An operation of the normal drive will be explained. Assume that the voltage being applied to the liquid crystal (pixel voltage Vp') rapidly changes from high to low. As shown in FIGS. 9(*a*), 9(*c*), when the gate signal is output to the pixel, the switching element is placed in the conductive state in the write period Ta during which the voltage has a high value and the pixel electrode is charged by the voltage of the source signal. The write period Ta is, for example, 20 μs and is therefore very short. However, even in the case of the liquid crystal of the OCB mode, the response time of the liquid crystal molecules has a value of several ms order and is longer than charge time. Since the dielectric constant of the liquid crystal changes according to the response of the liquid crystal molecules as described above, the response of the dielectric constant is also slow. In the initial stage of charge, the voltage applied to the liquid crystal, i.e., the pixel voltage Vp' changes as shown in FIG. 9(*b*), while the dielectric constant of the liquid crystal is kept high at a high voltage as shown in FIG. 9(*d*). Then, when the switching element is placed in the cut-off state and the hold period begins, the liquid crystal molecules respond and the dielectric constant correspondingly changes. The change of the dielectric constant causes electric charges to be re-distributed and the pixel voltage Vp' changes as shown in FIGS. 9(*b*), 9(*c*). This brings about difference between the pixel voltage Vp' and the set pixel voltage Vp. As a result, as shown in FIG. 9(*e*), the transmittance gradually changes over a number of fields more than a field period Tf. That is, the response of the liquid crystal is slow. Here, the pixel voltage Vp' is represented by:

$$Vp'=(Cst+Clc(0))/(Cst+Clc(100))\times Vp$$

In summary, the problem with the normal drive is that the change of the dielectric constant of the liquid crystal changes the pixel voltage Vp' such that the pixel voltage Vp' degrades the response of the liquid crystal.

Accordingly, in this embodiment, the change of the dielectric constant changes the pixel voltage Vp' so that the pixel voltage Vp' quickens the response speed of the liquid crystal. Specifically, a pulse gate signal is adopted in this embodiment like the normal drive as shown in FIG. 10(*a*) but the compensation voltage Vcc is applied to the pixel electrode from the gate electrode via the storage capacitor Cst in the initial stage of the hold period Th just after the end of the write period Ta as shown in FIG. 10(*b*). During this application, the dielectric constant of the liquid crystal gradually changes as shown in FIG. 10(*d*) and the compensation voltage Vcc correspondingly changes as shown in FIG. 10(*b*). This change of the compensation voltage Vcc according to the change of the dielectric constant quickens the response of the liquid crystal. For this reason, as shown in FIG. 10(*e*), the transmittance does not respond slowly but instead, changes as quickly as temporal overshooting. This change makes the change in the transmittance rapid. Thereby, the liquid crystal can finish response within one picture, that is, within one field period Tf.

As should be appreciated, the present invention is characterized in that the compensation voltage is applied to permit a faster response of the liquid crystal, and the CC drive is defined as the drive carried out by automatically applying the compensation voltage according to the change in the capacity for the liquid crystal capacitor.

Subsequently, effects of the liquid crystal display according to this embodiment will be explained. In the normal drive, although the OCB liquid crystal mode permits high speed response, it was difficult to realize the response within one field regardless of the OCB liquid crystal mode. This is because the change of the dielectric constant impedes the high-speed response of the liquid crystal as described above. Accordingly, the OCB liquid crystal mode and the CC drive are combined to reliably achieve the response within one field period.

Figure 11:
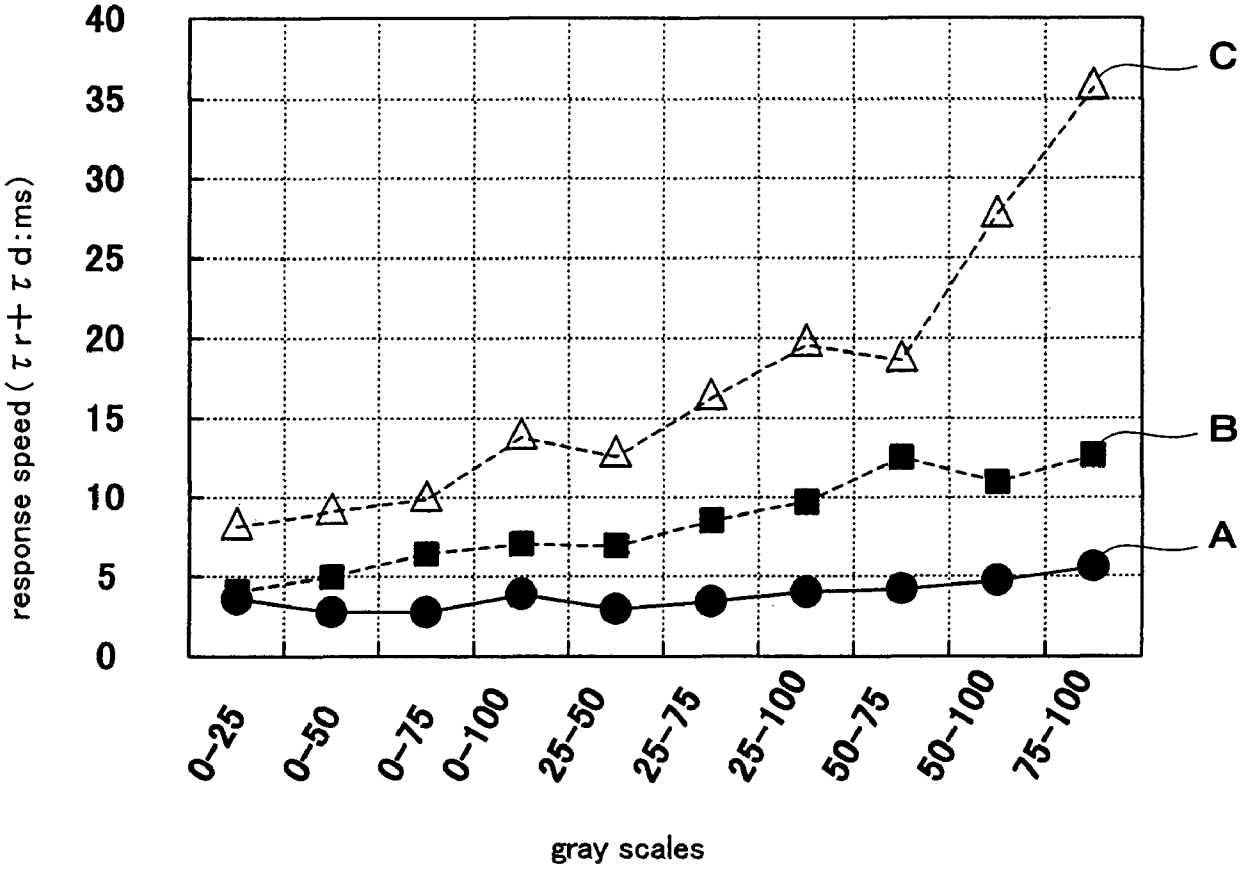
FIG. 11 is a graph showing a response speed between gray scales of the liquid crystal display.

FIG. 11 is a graph showing a response speed between gray scales of the liquid crystal display. FIGS. 12(*a*)-12(*c*) are tables showing Rise time and Decay time between gray scales, wherein FIG. 12(*a*) shows a table for the OCB liquid crystal mode of the normal drive, FIG. 12(*b*) shows a table for the OCB liquid crystal mode of the CC drive, and FIG. 12(*c*) shows a table for the TN liquid crystal mode of the CC drive. As shown in FIGS. 12(*a*), (*b*), (*c*), for the purpose of confirming the effects of the liquid crystal display of the embodiment, Rise time and Decay time between gray scales were measured in each of the OCB liquid crystal mode of the normal drive, the OCB liquid crystal mode of the CC drive (this embodiment), and the TN liquid crystal mode of the CC drive. This measurement was made at a room temperature in the OCB liquid crystal mode of the normal drive, and at 32° C. in the OCB liquid crystal mode of the CC drive and the TN liquid crystal mode of the CC drive. In tables of FIGS. 12(*a*), (*b*), (*c*), numeric values surrounded by a dotted line denote Decay time (τd) and numeric values surrounded by a dashed line denote Rise time (τr). The numeric values representing levels of the respective gray scales are given in terms of percentage assuming that a black display level of the luminance of the screen is "0" and a white display level of the luminance is "100". To clarify the measurements, the response speeds for the associated gray scales are graphically illustrated in FIG. 11. Here, the associated gray scales refer to two gray scales for which the responses speed is to be calculated. The response time is the sum of Rise time from one of the two gray scales to the other and Decay time from the other to the one. In general, in the liquid crystal display, the response time is thus represented by the sum of Rise time and Decay time. By way of example, in the OCB liquid crystal mode of the normal drive (FIG. 12(*a*)), when the associated gray scales are at a level of 0 and a level of 25 (in FIG. 11, expressed as 0-25), the response speed is:

$$0.92(\tau r)+3.2(\tau d)=4.12\ [\mathrm{ms}]$$

In FIG. 11, the characteristic of the OCB liquid crystal mode of the normal drive is indicated by a curved line B. As can be clearly seen from the curved line B, the response speeds of the OCB liquid crystal mode of the normal drive in the intermediate gray scales are still low in practice. To provide the moving picture as sharp as that of the CRT, is necessary to insert black pictures. For this purpose, it is necessary to write the video signal at a frequency higher than a normal field frequency of 60 Hz, and insert the black picture for the remaining time. If possible, in order to obtain desired sharpness of the moving picture, it is desirable to set the time at which the black picture is inserted to at least more than half of one field period. Therefore, it is necessary to write the video signal at a frequency of 120 Hz. So, a response speed of 8 ms or less is required. Also, to operate the liquid crystal display element in association with the backlight or implement high speed response even at a low temperature, a higher speed response speed is required. Herein, write of the video signal at 120 Hz is referred to as "double speed drive".

In the OCB liquid crystal mode of the normal drive, the response speed between gray scales is 12.8 ms at maximum. The OCB mode of the normal drive is capable of performing "high speed drive" to some degree as well as writing of the video signal at a field frequency of 60 Hz but is incapable of writing of the video signal at 120 Hz enabling the display of the sharp moving picture", i.e., "double speed drive". Consequently, the OCB liquid crystal mode of the normal drive is impracticable for use in television, monitor, or the like.

The characteristic of the OCB liquid crystal mode of the CC drive is indicated by a curved line A in FIG. 11. As can be clearly seen from a curved line A, the response speed between gray scales was 6 ms at maximum (more accurately, 5.4 ms or less). The response seed is less than half of that of the OCB liquid crystal mode of the normal drive and considerably lower than 8 ms corresponding to the video signal write period (hereinafter referred to as an image information write period) at a frequency of 120 Hz enabling the display of the sharp moving picture. Therefore, the liquid crystal display of this embodiment is capable of performing "double speed drive" as well as "high speed drive" and consequently, can be practically used in television, monitor, or the like in terms of the response speed. In brief, only the liquid crystal display of this embodiment realized the practical moving picture display in terms of the response speed for the first time.

The characteristic of the TN liquid crystal mode of the normal drive widely used currently is indicated by a curved line C in FIG. 11. In this liquid crystal mode, gray scales in which response in time less than the field period of 60 Hz is possible are very few. So, this liquid crystal display is unsatisfactorily capable of performing "high speed drive" as well as "double speed drive". The response speed thereof is low for the display of the moving picture.

Figure 13B:
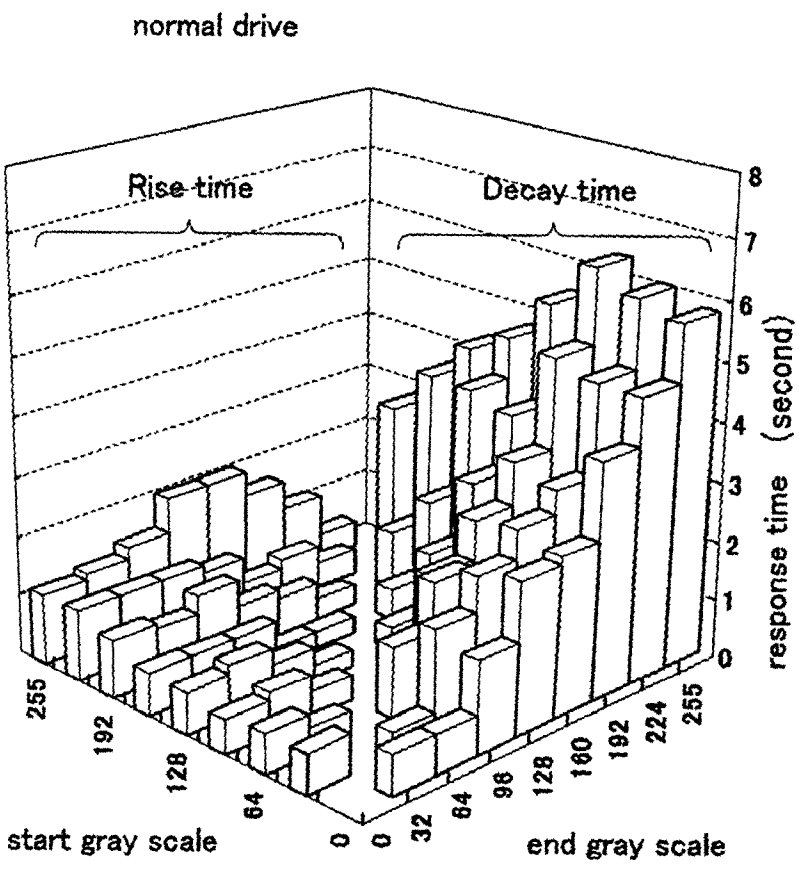
FIGS. 13(*a*), 13(*b*) are three-dimensional graphs visually showing Rise time and Decay time between gray scales, wherein FIG. 13(*a*) shows a table for the OCB liquid crystal mode of the CC drive and FIG. 13(*b*) shows a table for the OCB liquid crystal mode of the normal drive.
Figure 13A:
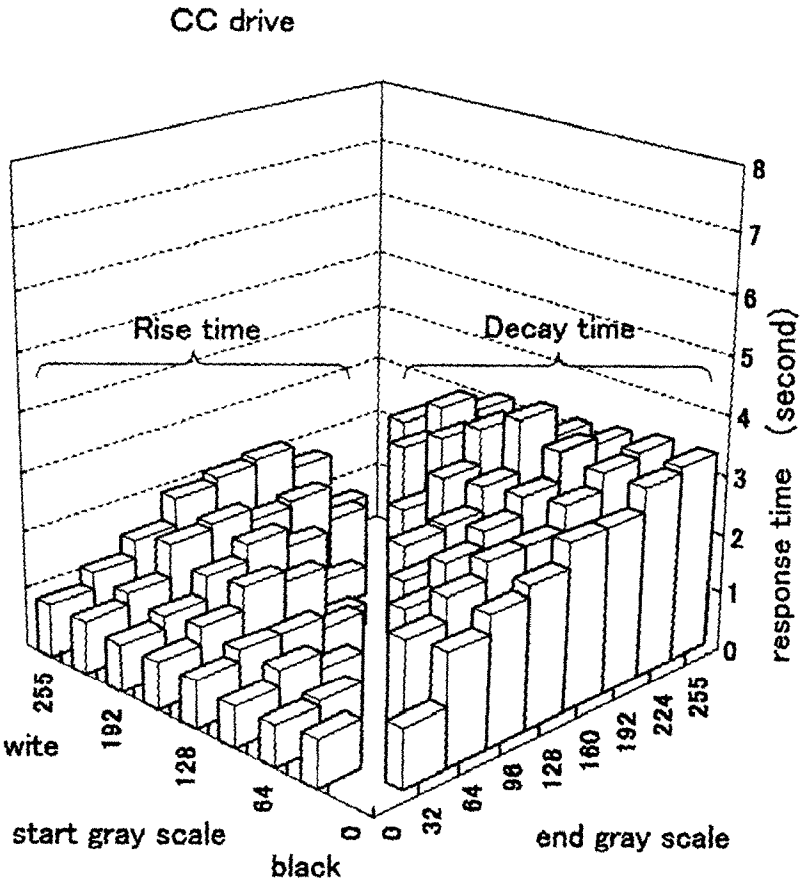

FIGS. 13(*a*), 13(*b*) are three-dimensional graphs visually showing Rise time and Decay time between gray scales, wherein FIG. 13(*a*) shows a table for the OCB liquid crystal mode in the CC drive and FIG. 13(*b*) shows a table for the OCB liquid crystal mode in the normal drive.

FIGS. 13(*a*), 13(*b*) show measurement of Rise time and Decay time between gray scales which have levels more than those of the measurement of FIG. 12. The level of each gray scale is represented by a level of luminance of a screen assuming that black display is 0 and white display is 255.

As can be seen from FIGS. 13(*a*), 13(*b*), the OCB liquid crystal mode of the CC drive particularly improves the response time in Decay time, i.e., in the direction in which the liquid crystal is relaxed as compared to the OCB liquid crystal mode of the normal drive. In the OCB liquid crystal mode of the CC drive, the response time is approximately 3 ms or less between any gray scales and the response speed ($\tau r+\tau d$) is 6 ms or less. Further, the difference between gray scales is significantly smaller than that of the OCB liquid crystal mode of the normal drive. This is due to the fact that the highest compensation voltage is automatically applied to the pixel electrode in transition from the black display level to the while display level in which the response speed becomes lowest. Thus, even when the gray scales have thus more levels, the liquid crystal display of this embodiment has the response speed practicable for use in television, monitor, or the like.

Subsequently, a temperature characteristic of the liquid crystal display according to the embodiment will be explained. In the OCB liquid crystal mode of the CC drive, the lower limit of temperature at which "double speed" was possible was 10° C. It should be remembered that 10° C. refers to the temperature of the liquid crystal display element warmed by the backlight or the like and an ambient temperature in this case was 10° C. This means that the liquid crystal display of this embodiment realized satisfactorily preferable "double speed drive" below the room temperature. On the other hand, in the OCB liquid crystal mode of the normal drive, the lower limit of temperature at which the drive at the field frequency of 60 Hz was possible was 25° C., and below 25° C., even the drive at 60 Hz was difficult.

Subsequently, preferable conditions of this embodiment will be described. The high speed response by the CC drive is brought about by the overlapped compensation voltage Vcc and the change in the pixel voltage Vp' due to the dielectric anisotropy as described above. Therefore, it is preferable that anisotropy of the dielectric constant is high. This embodiment adopted a liquid crystal material with the dielectric constant which is 11 under a full voltage, 5 under non-voltage, 10 under a black display voltage, and 7 under a white display voltage. One important parameter in selecting the liquid crystal material is the ratio of the dielectric constant under the black display voltage and the dielectric constant under the white display voltage (hereinafter referred to as a dielectric ratio) and the higher ratio is effective. In this embodiment, the liquid crystal material with the dielectric ratio of 1.4 was used. When the dielectric ratio is 1.2 or more, the high speed response is achieved, and when the ratio is 1.4 or more, the material was applicable to the "double speed drive" at a frequency of 120 Hz during the image information write period. In general, the TN liquid crystal has the dielectric ratio of 2 or more, while the OCB liquid crystal has a slightly lower dielectric ratio because the liquid crystal is used in the state in which liquid crystal molecules thereof are substantially raised. This limits the degree of freedom at which the liquid crystal material is selected. Accordingly, in this embodiment, the liquid crystal material with high dielectric constant anisotropy was selected, thereby improving the dielectric ratio. The dielectric constant of the liquid crystal material used in this embodiment was $\in$vertical=3.7, $\in$parallel=11.5. Therefore, the dielectric constant anisotropy $\Delta\in=\in$ parallel$-\in$ vertical=7.8 As for the selection of the liquid crystal material, when $\Delta\in>6.5$, the dielectric ratio is 1.2 or more, and the high speed response is achieved, and when $\Delta\in>7.7$, the dielectric ratio is 1.4 or more and the material was applicable to the "double speed drive".

Another important parameter in the CC drive is the ratio of a capacity for the storage capacitor Cst to a capacity for the liquid crystal capacitor Clc and larger capacity for the storage capacitor Cst is effective. In this embodiment, the capacity ratio Cst/Clc is set to 1. To achieve high speed response, the capacity ratio is preferably set to 0.7 or more. To apply to the "double speed drive", the capacity ratio is more preferably set to 1 or more.

As should be appreciated, according to this embodiment, the response time of the liquid crystal element can be reduced to ½ or less as compared to the conventional drive method. This is a very effective in view of empirical rule of the TN liquid crystal mode. It is considered that this effect is brought about by the characteristic of the OCB liquid crystal mode in which a variation in the amount of transmitted light with respect to the change of the dielectric constant of the liquid crystal is large. In other words, the effect of this embodiment is the synergism due to the compatibility of the configuration of the CC drive with the characteristic of the OCB liquid crystal mode rather than the sum of the high speed response effect by the CC drive and the high speed response effect of the OCB liquid crystal mode. Also, it was confirmed that the increase in the anisotropy of the dielectric constant further enhanced the effects of high speed response.

Subsequently, a modification of this embodiment will be described.

First Modification

The method for supplying the compensation voltage to the pixel electrode is not limited to a preceding gate method. What is needed is the compensation voltage is supplied to the pixel electrode from an electrode capacitively coupled thereto.

Figure 14:
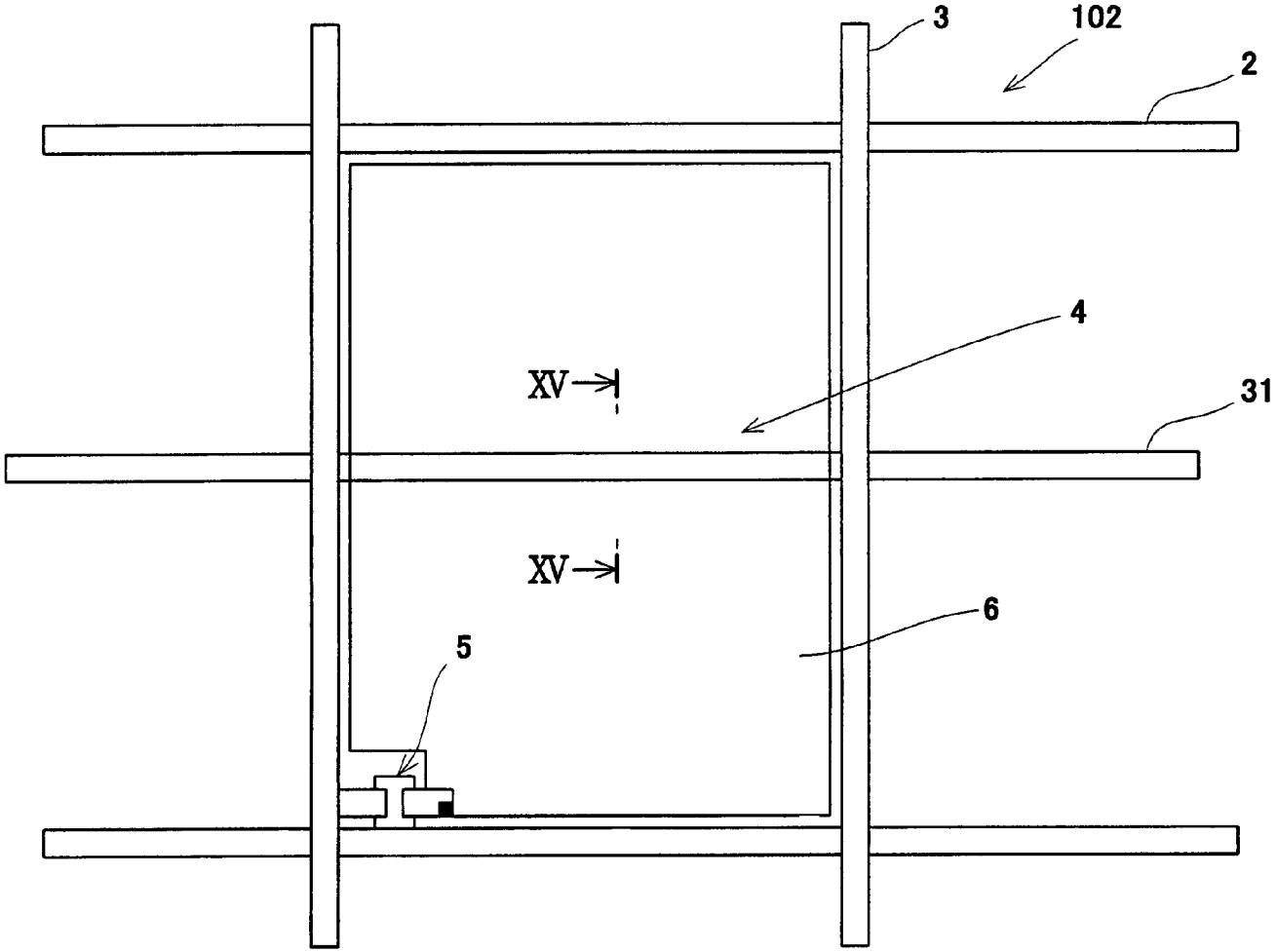
FIG. 14 is a plan view showing a structure of a capacitor line according to a first modification of the first embodiment.
Figure 15:
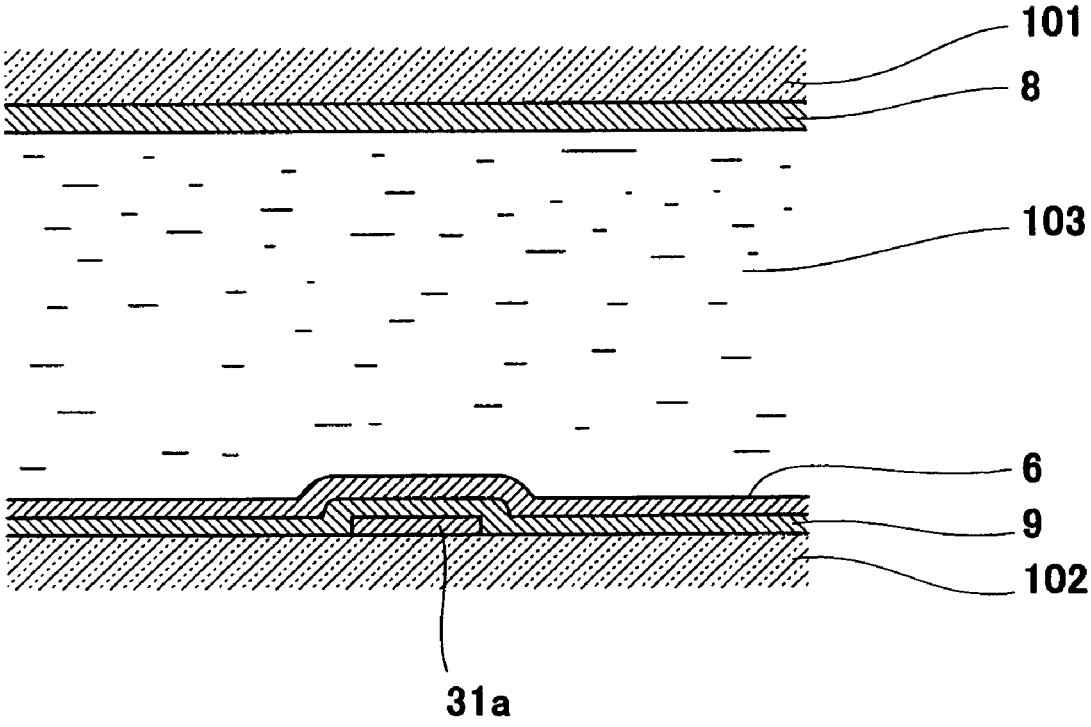
FIG. 15 is a cross-sectional view taken substantially along line XV-XV of FIG. 14.

FIG. 14 is a plan view showing a structure of a capacitor line according to the first modification, and FIG. 15 is a cross-sectional view taken substantially along line XV-XV of FIG. 14. Referring to FIG. 14, in this modification, a dedicated capacitor line 31 is formed on the inner surface of the TFT substrate 102 in parallel with the gate electrode 2. The capacitor line 31 is formed for each gate electrode 2. As shown in FIG. 15, the capacitor line 31 is covered by an insulating layer 9 on the TFT substrate 102 and a pixel electrode 6 is formed on the insulating layer 9. Therefore, a storage capacitor is formed between a portion 31*a* of the capacitor line 31 that is situated below the pixel electrode 6 and the pixel electrode 6. Although the capacitor line is generally connected to the counter electrode 8, the capacitor line 31 is connected to a dedicated driver (not shown). This is because the capacitor line 31 must be independently driven since a predetermined voltage must be applied to the capacitor line 31 in synchronization with scanning of the gate electrode 2. This results in the increased number of drivers on the gate side. So, these drivers are formed of polysilicon to allow load due to the increased drivers to be decreased. The voltage corresponding to Vg(+) and Vg(−) applied to the preceding gate electrode in FIG. 6 is applied to the capacitor line 31 by the dedicated driver at the timing of FIG. 6. Consequently, the effects of FIG. 6 can be provided.

Second Modification

In the above-described example, the compensation voltage is supplied from the capacitively coupled gate electrode to be automatically overlapped. The primary aim of the present invention is to apply the compensation voltage so as to accelerate the change in the transmittance of the liquid crystal display element, and is therefore achieved without the use of the capacitive coupling. Accordingly, in this modification, a compensation voltage application circuit for this purpose is embodied.

Figure 16:
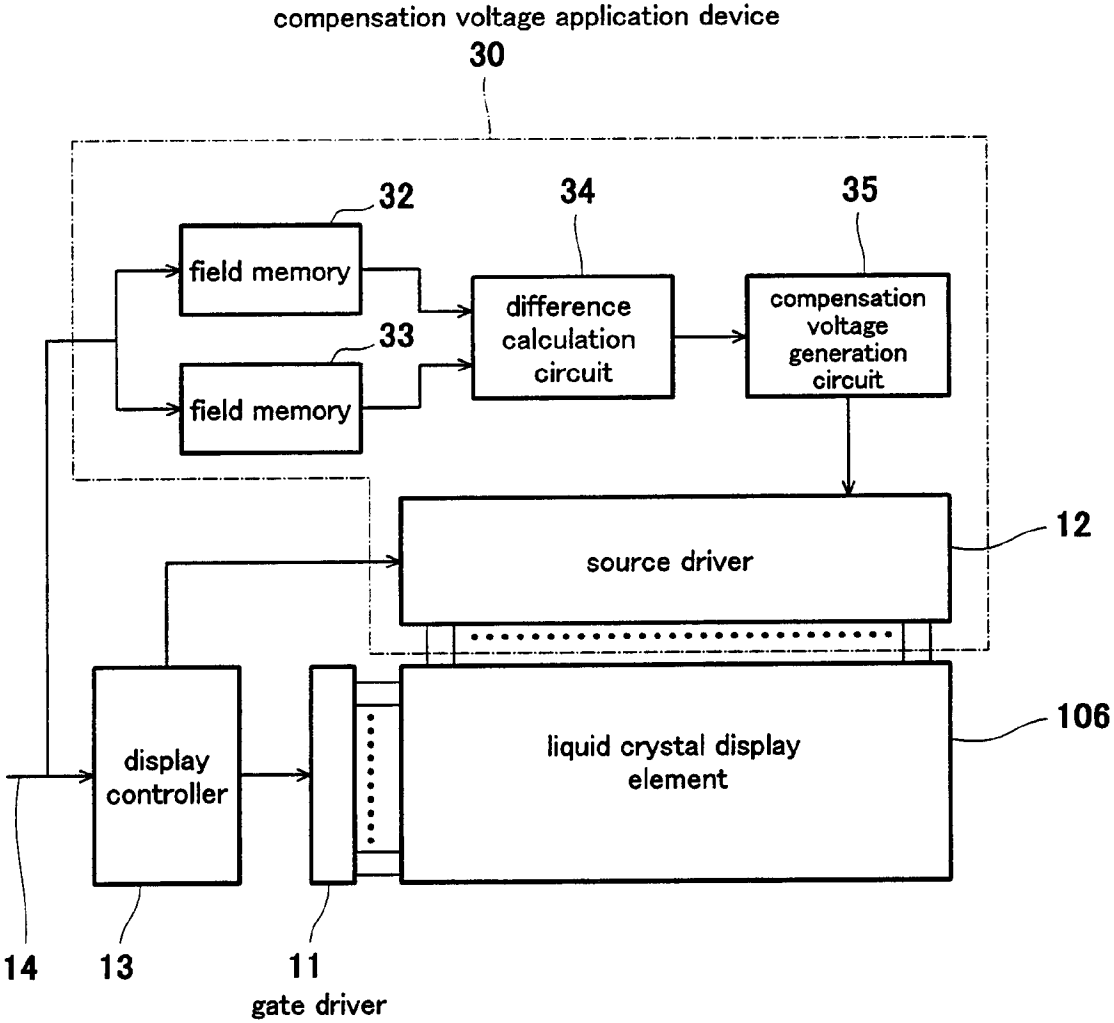
FIG. 16 is a block diagram showing a structure of a compensation voltage application device according to a second modification of the first embodiment.

FIG. 16 is a structure of a compensation voltage application device according to this modification. Referring to FIG. 16, a compensation voltage application device 30 comprises a plurality of (in this modification, two) field memories 31, 32 for respectively storing image information of preceding one picture (one field) and current one picture(one field) of the video signal 14, a difference calculation circuit 34 for calculating difference in gray scales (luminance information) of pixels of the image information stored in the field memories 32, 33, a compensation voltage generation circuit 35 for generating the compensation voltage having a value corresponding to the difference in the gray scales, and a source driver 12 for supplying the voltage (source signal) with the compensation voltage overlapped with the base voltage (voltage Vs of the source signal of FIG. 6) based on the gray scales of the pixels in the current field of the video signal 14. In the status quo, the calculation of the difference in gray scales of respective pixels between fields requires a great quantity of calculations and is therefore difficult to realize due to its calculation speed. In the future, small-sized and high-speed semiconductor devices will be developed to allow the calculation to be executed in a controller chip, and such calculations will be carried out.

Third Modification

In the embodiment described above, the OCB liquid crystal mode of the CC drive is employed to realize a higher speed response, while in this modification, the insertion of the black picture within the field period is combined into the OCB liquid crystal mode of the CC drive. With such a configuration, the sharpness of the moving picture, i.e., viewability thereof is improved. Here, the field period is defined as a cycle in which image information (video signal) corresponding to one picture is written. Also, a period in the field period during which the image information corresponding to one picture is sequentially written to all the pixels is called an image information write period. Further, a period in the field period during which the black picture is written is called a black picture insertion period. In this modification, effects were provided when the image information write time was less than 90% of the field period. For example, when the black picture insertion period was set to 10% or more of the field period, the liquid crystal hardly returned to the spray orientation, that is, hardly transitioned backward. When the image information write period is set to less than half of the field period, the remaining period is used as the black picture insertion period. Therefore, viewability can be further improved. It should be noted that the voltage for black picture display may be a black level or substantially black level voltage, or a voltage higher than the black level.

Fourth Modification

In this modification, the backlight is turned off during the black picture insertion period within the field period. More specifically, in the configuration of FIG. 1, the lighting controller 17 controls the lighting circuit 16 to turn off the light source 15 over the whole period of the black picture insertion period. With this configuration, improved viewability and reduced power consumption associated with the insertion of the black picture are achieved.

Fifth Modification

In this modification, in the liquid crystal display in the TN liquid crystal mode of the CC drive, a cell thickness is set to 3 μm or less. Thus reduced cell thickness provides large strength of an electric field generated in the liquid crystal. Thereby, the high speed response is achieved. When the cell thickness was 3 μm or less, "double speed drive" was achieved as in the case of the OCB liquid crystal mode of the CC drive. Off course, a higher response is obtained in this configuration by selecting the dielectric constant anisotropy and the dielectric ratio of the liquid crystal material as described above.

Second Embodiment

The CC drive employed in the first embodiment advantageously optimizes the drive voltage as well as permits the high speed response. In the second embodiment, the offset voltage is applied by utilizing the CC drive.

Figure 17:
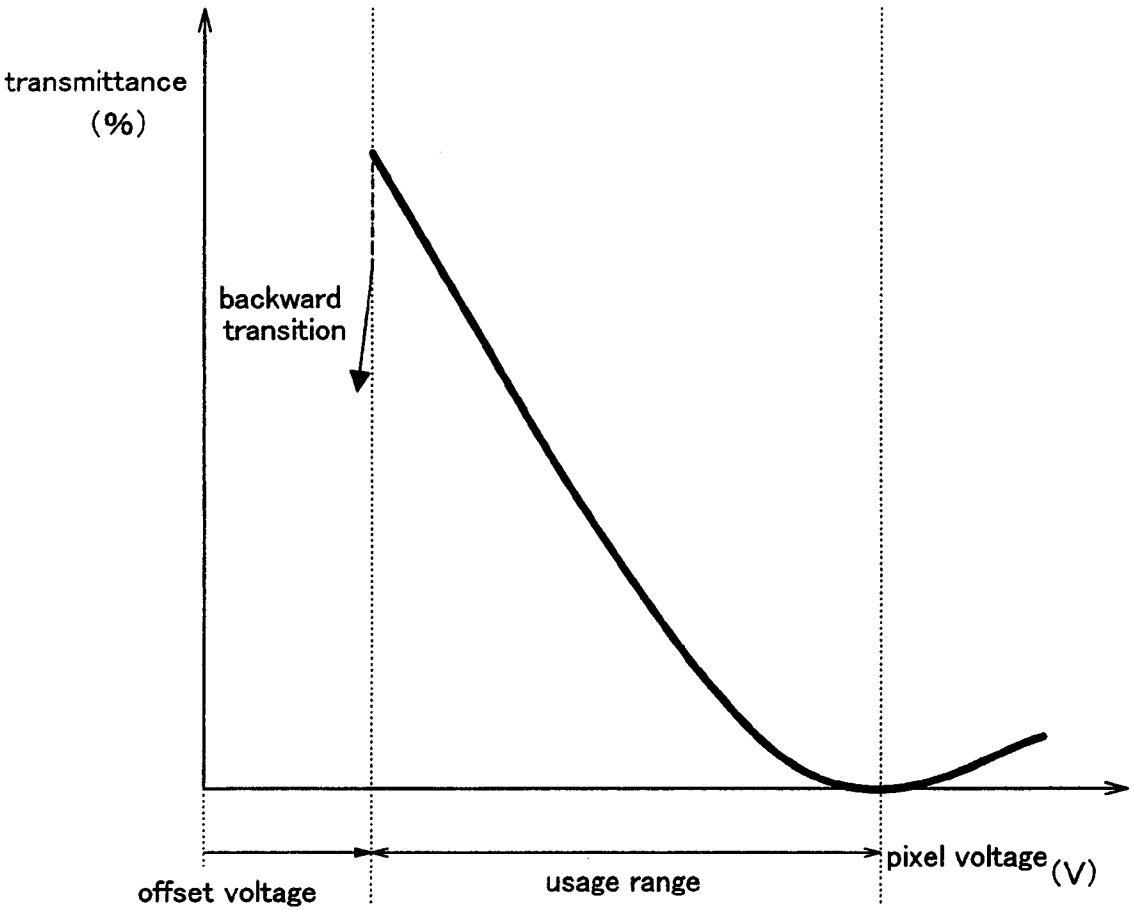
FIG. 17 is a pixel voltage-transmittance graph, showing how an offset voltage is set in a liquid crystal display according to a second embodiment of the present invention.

FIG. 17 is a pixel voltage-transmittance graph, showing how an offset voltage is set in a liquid crystal display according to this embodiment.

The whole configuration of this embodiment is identical to that of the first embodiment except that the compensation voltage Vcc of FIG. 7 (hereinafter referred to as a cumulated voltage) is set as including the offset voltage. Herein, the offset voltage is defined as the voltage applied to prevent the liquid crystal with bend orientation from transitioning backward to spray orientation, as shown in FIG. 17. In this embodiment, the offset voltage is set to 2V. The electrode capacitively coupled may be the gate electrode or the dedicated capacitor line like the first embodiment. Since the backward transition of the liquid crystal is prevented by utilizing the CC drive, it can be carried out in a simplified way.

The problem associated with the OCB liquid crystal display is that the spray orientation tends to be generated at a very low voltage. For this reason, in general, there has been used a drive method in which the pixel voltage is set to a fixed value or more. One preferable drive method may be that the potential of the counter electrode is changed in the form of the AC square waveform, and thereby the offset voltage is applied.

This drive method is suitable for a small-sized liquid crystal panel (liquid crystal display element) but is less suitable for a large-sized liquid crystal panel. This is because a CR time constant during charge is too large due to a too large capacity of the liquid crystal panel. According to the study by the inventor of this invention, in practice, it was impossible to apply the offset voltage to the liquid crystal panel of 10 inch type or more by the above drive method. Further, without the CC drive, it was impossible to apply the offset voltage to the liquid crystal panel of 15 inch type or more. Here, x type means that the length of a diagonal line of a substantially rectangular display screen of the liquid crystal panel is x inches.

Accordingly, in this embodiment, the offset voltage is applied by utilizing the CC drive.

By the way, in the OCB liquid crystal display, the voltage at which the liquid crystal transitions backward to the spray orientation depends on a pretilt angle. When the pretilt angle was 15 degrees, this backward transition voltage was 1 v. According to the study of the inventor, the general OCB liquid crystal panel required the offset voltage of 1 v or more. Also, when the black picture was inserted into one field, a lower offset voltage was satisfactorily used. That is, the bend orientation is kept by the insertion of the black picture even if the lower voltage is temporarily applied to the liquid crystal. In this case, however, it should be remembered that a critical voltage at which backward transition to the spray orientation takes place is just lowered, and therefore, the offset voltage needs to be always applied. The offset voltage in this case may be 1 v or less.

Third Embodiment

The third embodiment employs the CC drive in transition from the spray orientation to the bend orientation at the activation of the liquid crystal display.

Figure 18:
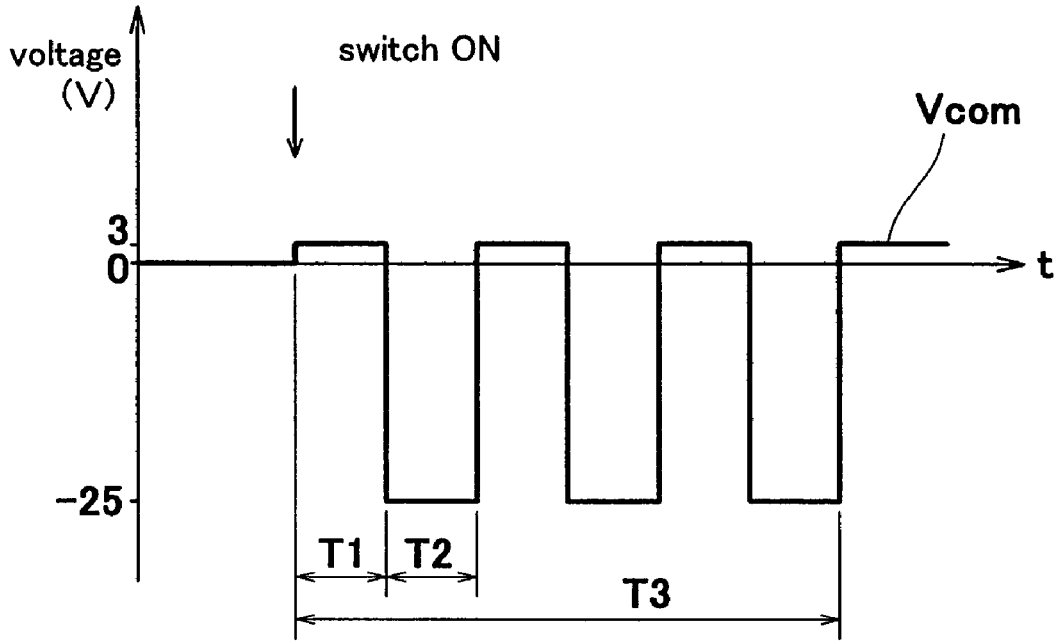
FIG. 18 is a graph showing a waveform of the counter voltage at activation of a liquid crystal display according to a third embodiment of the present invention.
Figure 19B:
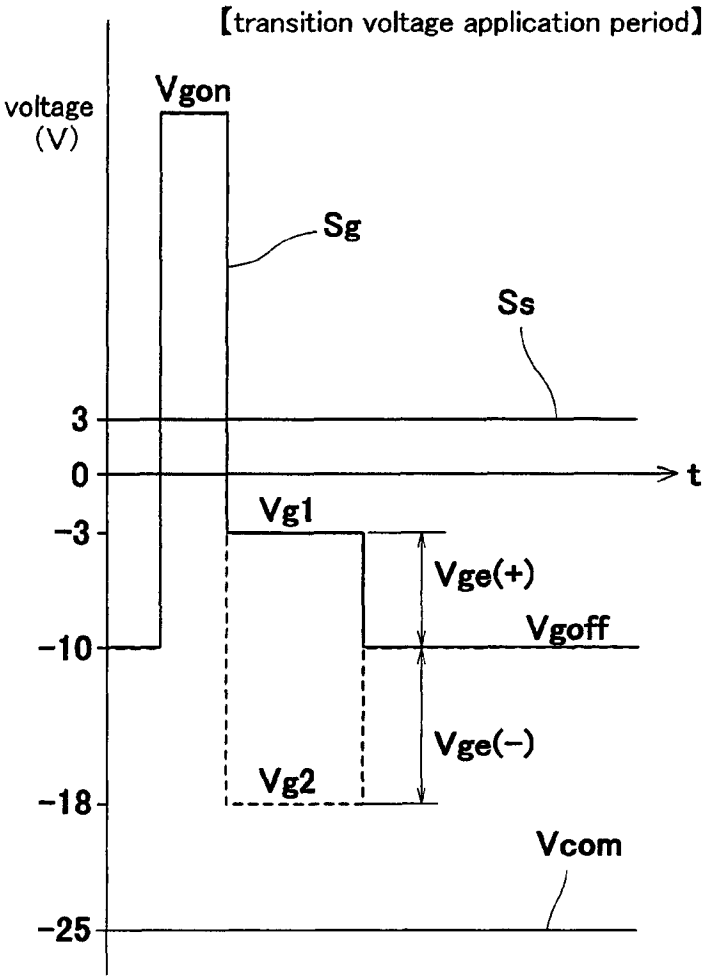
FIGS. 19(*a*), 19(*b*) are graphs each showing waveforms of the counter voltage, the gate signal, and the source signal at the activation of the liquid crystal display according to the third embodiment, wherein FIG. 19(*a*) shows the waveforms in an inactive period and FIG. 19(*b*) shows the waveforms in a transition voltage application period.
Figure 19A:
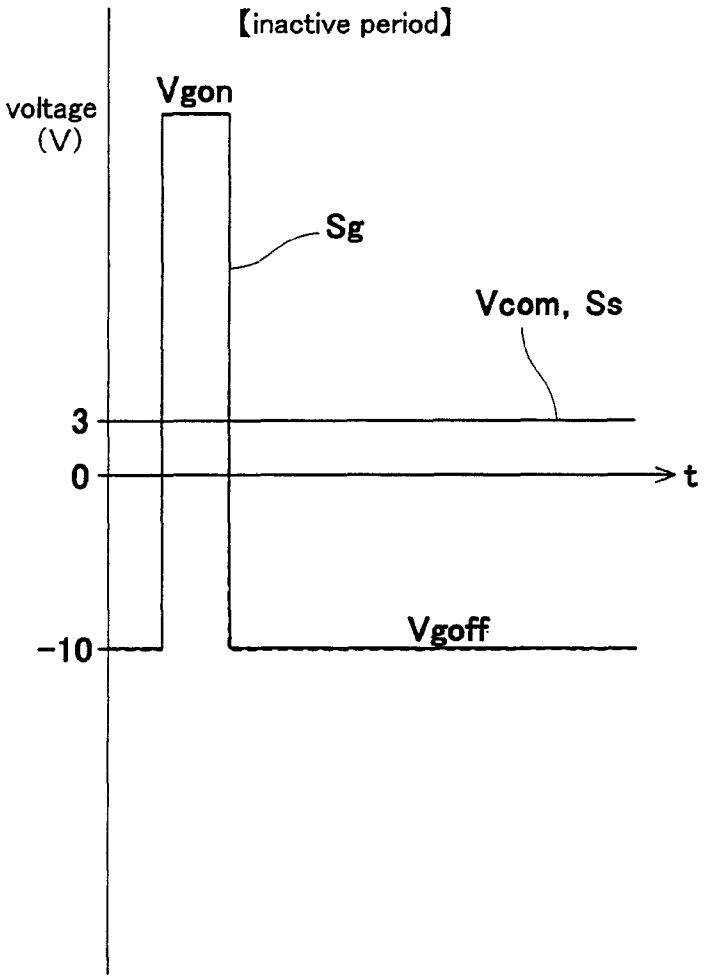

FIG. 18 is a graph showing a waveform of the counter voltage at activation of a liquid crystal display according to the third embodiment. FIGS. 19(*a*), 19(*b*) are graphs each showing waveforms of the counter voltage, the gate signal, and the source signal at the activation of the liquid crystal display according to the third embodiment, wherein FIG. 19(*a*) shows the waveforms in an inactive period and FIG. 19(*b*) shows the waveforms in a transition voltage application period. In FIGS. 18, 19, the same reference numerals of FIG. 6 denote the corresponding or same parts.

The liquid crystal display of this embodiment has the configuration of the first embodiment and is adapted to output the counter voltage, the gate signal, and the source signal in waveforms described below when activated. The liquid crystal display is provided with a driver for driving the counter electrode.

As shown in FIG. 18, when the liquid crystal display is activated, the counter voltage Vcom having an AC waveform at a low frequency of 5-10 Hz is applied to the counter electrode over a predetermined transition period T3. The counter voltage Vcom has the AC waveform in which an inactive period T1 taking 3V and a transition voltage application period T2 taking −25V are alternately repeated. The counter voltage Vcom has a value of 3V to prevent the voltage from being applied to the liquid crystal.

Referring to FIGS. 19(*a*), 19(*b*), the gate signal Sg is output to the gate electrode during the transition voltage application period. The gate signal Sg takes two values of Vgon and Vgoff during the inactive period T1 as shown in FIG. 19(*a*) and four values identical to those after transition (see FIG. 6) during the transition voltage application period as shown in FIG. 19(*b*). In this state, the cumulated voltage Vcc was applied to the pixel electrode during the transition voltage application period T2. As a result, the transition voltage of actually 30 v or more was applied to the liquid crystal, although only the transition voltage of +3−(−25)=28V was applied to the liquid crystal in the normal drive method. This was due to the fact that the cumulated voltage Vcc of 2V or more was generated. When the gate signal Sg took Vge2, a particularly high cumulated voltage Vcc was generated, and a high transition voltage was correspondingly applied. From this fact, it is preferable that the gate signal Sg takes three values of Vgon, Vgoff, Vge2 during the transition voltage application period T2. In this case, it should be remembered that a work of another routine is imposed on a gate driver because the waveform of the gate signal sg is different from the waveform after transition.

On the other hand, the two-valued signal is output during the inactive period T1. The reason is as follows. For preferable transition, it is desirable that no voltage is applied to the liquid crystal during the inactive period T1. However, if the four-valued signal is output like during the transition voltage application period T1, the CC drive causes the cumulated voltage Vcc to be applied to the liquid crystal. Accordingly, the gate signal Sg during the inactive period T1 was set as the two-valued signal to prevent the generation of the cumulated voltage Vcc.

The source signal Ss has a voltage equal to the counter voltage Vcom during at least the inactive period T1 to prevent the voltage from being applied to the voltage during the inactive period T1. In this embodiment, in the transition period T3, the source signal Ss is set to a constant value of 3 v during the inactive period T1 and the transition voltage application period T2.

In this embodiment, with the above-described configuration, high speed transition was achieved. Specifically, the transition time, which was conventionally 3 seconds, was reduced to 2 seconds.

One example of prior arts is disclosed in Japanese Laid-Open Patent Application No. Hei. 9-185037. In this prior art, the gate voltage as the transition voltage being applied was always set to High level. In this embodiment, for the efficient transition, the gate electrode is scanned like the display state (after transition) and thereby, the cumulated voltage Vcc is efficiently utilized during transition.

Figure 20:
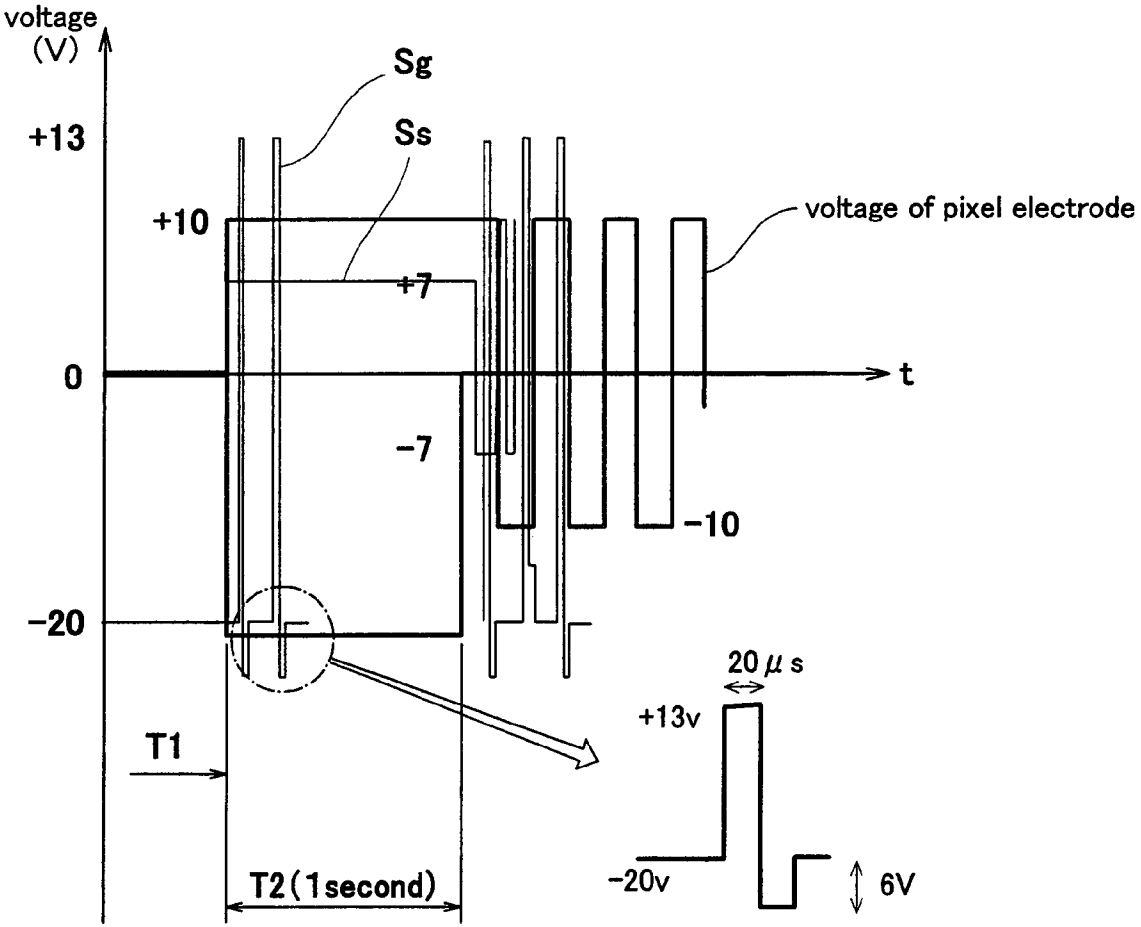
FIG. 20 is a graph showing waveforms of the counter voltage, the gate signal, the source signal, and the voltage of the pixel electrode according to a modification of the third embodiment.

Subsequently, a modification of this embodiment will be described. FIG. 20 is a graph showing waveforms of the counter voltage, the gate signal, the source signal, and the voltage of the pixel electrode according to this modification.

In this modification, during the inactive period T1, the source signal Ss and the counter voltage Vcom are both set to 0 v and no voltage is therefore applied to the liquid crystal. During the transition voltage application period T2, the counter voltage Vcom is greatly swung to −20V, whereas the source signal Ss is swung to +7 v. The gate signal Sg is a three-valued signal as shown in an enlarged view of dot-lined portion of FIG. 20. Thereby, the cumulated voltage Vcc by the CC drive is applied to the pixel electrode. As a result, in the pixel electrode, the cumulated value Vcc is cumulated on the voltage 7V of the source signal Ss and the potential thereof is +10 v. Thereby, the pixel voltage is as high as 30 v and applied to the liquid crystal. Since the gate signal Sg during the transition voltage application period T2 is the three-valued signal, the cumulated voltage Vcc having one polarity is overlapped and is as high as approximately 3 v. Here, the transition voltage application period T2 is set to about 1 second. As described above, the gate signal Sg was set as the two-valued signal during the inactive period T2. During the inactive period T1, the potentials of the source electrode and the counter electrode may vary so long as these electrodes have the same potential, but this display was quite stable when these potentials were kept constant.

While in the first to third embodiments, the layered electrode made of a conductive material is formed on the inner surface of the substrate as an electrode portion, this electrode portion is only illustrative. For example, between the electrode and the liquid crystal, there may be placed an electric characteristic variant in which its electric characteristic thereof switches between insulativity and conductivity by irradiation of light, and the electric characteristic variant and the electrode may constitute the electrode portion.

Numerous modifications and alternative embodiments of the invention will be apparent to those skilled in the art in view of the foregoing description. Accordingly, the description is to be construed as illustrative only, and is provided for the purpose of teaching those kill d in the art the best mode of carrying out the invention. The details of the structure and/or function may be varied substantially without departing from the spirit of the invention and all modifications which come within the scope of the appended claims are reserved.

INDUSTRIAL APPLICABILITY

The liquid crystal display of the present invention is useful as a liquid crystal television, a liquid crystal monitor, or the like for displaying the moving picture requiring high speed response.

The invention claimed is:

1. A liquid crystal display that employs an optically compensated bend liquid crystal mode capable of transitioning liquid crystal molecules from splay orientation to bend orientation, comprising:

a liquid crystal layer with the liquid crystal molecules held in the bend orientation between pixel electrodes and a counter electrode;

a display screen including a plurality of pixels arranged in matrix, on which an image is displayed by light transmitted through the liquid crystal layer, each of the plurality of pixels including a pixel electrode connected with a switching element, the counter electrode, a storage capacitor portion situated below the pixel electrode through an insulating layer to form a storage capacitor and the liquid crystal layer;

a gate driver for sequentially scanning the plurality of pixels by a gate voltage applied to a gate electrode; and a source driver for applying a base voltage to the pixel electrode of the pixels during a write period by sequentially scanned, through a source electrode and the switching element, the base voltage being variable according to luminance information for each field of image information for displaying the image on the display screen; and a circuit configured for applying a compensation voltage to a corresponding pixel electrode in accordance with the luminance information through the storage capacitor portion so as to compensate for the base voltage to adjust a voltage at the corresponding pixel electrode to a voltage as indicated by the luminance information during a cumulating period subsequent to the write period for cumulating the compensation voltage to the base voltage, in order to enable a faster drive of the liquid crystal molecules in the bend orientation for displaying the image on the display screen.

2. The liquid crystal display according to claim 1, wherein an image information write period during which the image information of one field is sequentially written to all pixels occupies less than 90% of a field period corresponding to a predetermined cycle in which the image information of one field is written.

3. The liquid crystal display according to claim 2, wherein the image information write period is less than 16.6 ms.

4. The liquid crystal display according to claim 2, wherein the image information write period occupies less than half of the field period.

5. The liquid crystal display according to claim 4, wherein the image information write period is less than 8 ms.

6. The liquid crystal display according to claim 2, wherein a voltage is applied to the pixel electrode to display a substantially black picture on the display screen during a period of the field period except the image information write period.

7. The liquid crystal display according to claim 2, further comprising:

a lighting device including a light source for supplying the light transmitted through the liquid crystal layer and control means for controlling the light source to be tuned on during the image information write period of the field period and to be turned off during the remaining period.

8. The liquid crystal display according to claim 1, wherein a ratio of a capacity for the storage capacitor to the capacity for the liquid crystal capacitor of the pixel is 0.7 or more.

9. The liquid crystal display according to claim 8, wherein a ratio of a capacity for the storage capacitor to the capacity for the liquid crystal capacitor of the pixel is 1 or more.

10. The liquid crystal display according to claim 1, wherein a maximum level of the voltage at the pixel electrode and a minimum level of the voltage at the pixel electrode respectively correspond to upper and lower limit levels of the luminance information of the image information and a ratio of dielectric constant of the liquid crystal layer under the minimum level to dielectric constant of the liquid crystal layer under the maximum level is 1.2 or more.

11. The liquid crystal display according to claim 10, wherein the ratio of dielectric constant is 1.4 or more.

12. The liquid crystal display according to claim 1, wherein dielectric constant anisotropy of the liquid crystal molecules is 6.5 or more.

13. The liquid crystal display according to claim 12, wherein the dielectric constant anisotropy of the liquid crystal molecules is 7.7 or more.

14. The liquid crystal display according to claim 1, wherein a response speed between gray scales is 8 ms or less.

15. The liquid crystal display according to claim 14, wherein the response speed between gray scales is 6 ms or less.

16. The liquid crystal display according to claim 15, wherein the response speed between gray scales is 5.4 ms or less.

17. The liquid crystal display according to claim 1, wherein a response speed between gray scales is one field period or less.

18. A liquid crystal display that employs an optically compensated bend liquid crystal mode capable of transitioning liquid crystal molecules from splay orientation to bend orientation, comprising:

a plurality of signal and scanning lines;

pixel electrodes connected with switching elements, each of the switching elements connected with one of the signal lines and one of the scanning lines;

a storage capacitor portion situated below a corresponding pixel electrode through an insulating layer to form a storage capacitor;

a counter electrode opposed to the pixel electrodes;

a liquid crystal layer with the liquid crystal molecules held between the pixel electrodes and the counter electrode;

a gate driver for sequentially applying a gate voltage to the scanning lines during a write period;

a source drive for applying a base voltage to the pixel electrodes during the write period through the switching elements, the base voltage being variable according to luminance information for each field of image information for displaying the image on a display screen; and a circuit configured for applying a compensation voltage to the corresponding pixel electrode in accordance with the luminance information through the storage capacitor portion during a cumulating period subsequent to the write period for cumulating the compensation voltage to the base voltage, whereby the base voltage with the compensation voltage which is a voltage as indicated by the luminance information is applied to the pixel electrodes to enable a faster drive of the liquid crystal molecules in the bend orientation for displaying images according to luminance information.

19. The liquid crystal display according to claim 18, wherein dielectric constant anisotropy of the liquid crystal molecules is 6.5 or more.

20. The liquid crystal display according to claim 19, wherein the dielectric constant anisotropy of the liquid crystal molecules is 7.7 or more.

21. A liquid crystal display that employs an optically compensated bend liquid crystal mode capable of transitioning liquid crystal molecules from splay orientation to bend orientation, comprising:

a plurality of pixels arranged in matrix, each of which includes a liquid crystal capacitor having a pixel electrode connected with a switching element, a counter electrode, a storage capacitor portion situated below the pixel electrode through an insulating layer to form a storage capacitor and a liquid crystal layer held therebetween, and a capacitive coupling connected with the pixel electrode;

a gate driver for sequentially applying a gate voltage to the corresponding switching element during a write period;

a source driver for applying a base voltage to the pixel electrode during the write period through the switching element to which the gate voltage is applied, the base voltage being variable according to luminance information for each field of image information for displaying the image on a display screen; and a circuit configured for applying a compensation voltage to the pixel electrode in accordance with the luminance information through the storage capacitor portion during a cumulating period subsequent to the write period for cumulating the compensation voltage to the base voltage, the base voltage with the compensation voltage being a voltage as indicated by the luminance information, the compensation voltage being applied to enable a faster drive of the liquid crystal molecules in the bend orientation for displaying an image on a display screen, wherein a ratio of a capacity for the capacitive coupling to the capacity for the liquid crystal capacitor of the pixel is 0.7 or more.

22. The liquid crystal display according to claim 21, wherein the ratio of the capacity for the capacitive coupling to the capacity for the liquid crystal capacitor of the pixel is 1 or more.

23. The liquid crystal display according to claim 21, wherein dielectric constant anisotropy of the liquid crystal molecules is 6.5 or more.

24. The liquid crystal display according to claim 23, wherein the dielectric constant anisotropy of the liquid crystal molecules is 7.7 or more.

25. A liquid crystal display that employs an optically compensated bend liquid crystal mode capable of transitioning liquid crystal molecules from splay orientation to bend orientation, comprising:

a plurality of signal and scanning lines;

a plurality of pixel electrodes connected with switching elements, each of the switching elements connected with one of the signal lines and one of the scanning lines;

a storage capacitor formed between a pixel electrode and a preceding gate electrode located below the pixel electrode through an insulating layer in the order in which the pixels are scanned;

a counter electrode opposed to the pixel electrodes;

a liquid crystal layer with the liquid crystal molecules held between the pixel electrodes and the counter electrode;

a gate driver for sequentially applying a gate voltage to the scanning lines during a write period;

a source driver for applying a base voltage to the pixel electrodes during the write period through the switching elements, the base voltage being variable according to luminance information for each field of image information for displaying the image on a display screen; and a circuit configured for applying a compensation voltage to a corresponding pixel electrode in accordance with the luminance information through the preceding scanning line during a cumulating period subsequent to the write period, whereby the base voltage with the compensation voltage which is a voltage as indicated by the luminance information is applied to the corresponding pixel electrode through the storage capacitor to enable a faster drive of the liquid crystal molecules in the bend orientation for displaying an image according to luminance information.

26. The liquid crystal display according to claim 25, wherein dielectric constant anisotropy of the liquid crystal molecules is 6.5 or more.

27. The liquid crystal display according to claim 26, wherein the dielectric constant anisotropy of the liquid crystal molecules is 7.7 or more.

28. The liquid crystal display according to claim 25, wherein the response speed between gray scales is 8 ms or less.

29. The liquid crystal display according to claim 28, wherein the response speed between gray scales is 6 ms or less.

30. The liquid crystal display according to claim 29, wherein the response speed between gray scales is 5.4 ms or less.

* * * * *